US009840347B1

(12) United States Patent
Linnell et al.

(10) Patent No.: US 9,840,347 B1
(45) Date of Patent: Dec. 12, 2017

(54) ADHERING MODULAR ELEMENTS FOR PACKAGING STRUCTURES

(71) Applicant: X Development LLC, Mountain View, CA (US)

(72) Inventors: Jeff Linnell, San Francisco, CA (US); Matthew Bitterman, San Francisco, CA (US)

(73) Assignee: X Development LLX, Mountain View, CA (US)

( * ) Notice: Subject to any disclaimer, the term of this patent is extended or adjusted under 35 U.S.C. 154(b) by 388 days.

(21) Appl. No.: 14/574,201

(22) Filed: Dec. 17, 2014

(51) Int. Cl.

| | |
|---|---|
| ***B65B 55/20*** | (2006.01) |
| ***B65B 57/10*** | (2006.01) |
| ***B65B 23/00*** | (2006.01) |
| ***B65D 81/05*** | (2006.01) |
| ***B65D 81/09*** | (2006.01) |
| ***B65D 81/113*** | (2006.01) |

(52) U.S. Cl.
CPC ..... *B65B 55/20* (2013.01); *B65B 23/00* (2013.01); *B65B 57/10* (2013.01); *B65D 81/051* (2013.01); *B65D 81/09* (2013.01); *B65D 81/113* (2013.01); *B65B 2210/04* (2013.01)

(58) Field of Classification Search
CPC .. B65B 5/06; B65B 5/08; B65B 23/00; B65B 55/00; B65B 55/20; B65B 61/22; B65B 2210/04; B65D 81/051; B65D 81/09; B65D 81/113
USPC ..... 53/452, 456, 472, 503, 504; 206/592
See application file for complete search history.

(56) References Cited

U.S. PATENT DOCUMENTS

| | | | | |
|---|---|---|---|---|
| 2,579,036 A * | 12/1951 | Edelman | ..... | B65D 81/09 206/584 |
| 4,852,743 A | 8/1989 | Ridgeway | | |
| 5,196,150 A | 3/1993 | Mimura et al. | | |
| 5,236,507 A * | 8/1993 | Brown | ..... | B65B 55/20 118/302 |

(Continued)

FOREIGN PATENT DOCUMENTS

| | | |
|---|---|---|
| CN | 103640793 | 3/2014 |
| CN | 203558300 | 4/2014 |

(Continued)

OTHER PUBLICATIONS

Guo et al. "Shock Absorbing Characteristics and Vibration Transmissibility of Honeycomb Paperboard," IOS Press, Shock and Vibration 11, 2004 pp. 521-531.

*Primary Examiner* — Stephen F Gerrity
(74) *Attorney, Agent, or Firm* — Fish & Richardson P.C.

(57) ABSTRACT

In response to a request to package item(s), embodiments determine characteristic data for the item(s), which include an indication of a volume of each item. Container(s) for packaging the item(s) is determined based at least on the volume of each item. An arrangement of the item(s) in the container(s) is determined. One or more protective structures including one or more features are configured to position the item(s) in the container(s) according to the arrangement. Relative positions are determined for a plurality of modular elements to form the one or more protective structures. Subsets of the plurality of modular elements are deposited to corresponding relative positions to form at least one of the protective structures. The item(s) are packaged in the container(s) with the one or more protective structures to position the item(s) in the container(s) in the arrangement.

25 Claims, 25 Drawing Sheets

(56) References Cited

U.S. PATENT DOCUMENTS 5,267,652 A 12/1993 Carroll
5,636,744 A 6/1997 Hirose
5,765,688 A 6/1998 Bertram et al.
6,092,651 A 7/2000 Miller
6,116,423 A 9/2000 Troxtell, Jr. et al.
6,158,589 A 12/2000 Smith et al.
6,200,245 B1 3/2001 Dodo et al.
6,721,762 B1 4/2004 Levine et al.
6,896,142 B2 5/2005 Kaltz, Jr. et al.
7,086,327 B2 8/2006 Futamura et al.
7,106,528 B2 9/2006 Ohmori et al.
7,298,385 B2 11/2007 Kazi et al.
7,364,042 B2 4/2008 Weder
7,588,148 B2 9/2009 Yang
7,647,752 B2 * 1/2010 Magnell ..... B65B 5/02 493/52
7,662,468 B2 2/2010 Bainbridge
7,731,033 B2 6/2010 Sattora et al.
7,739,894 B2 6/2010 Suzuki
7,814,733 B2 * 10/2010 Carlson et al. ..... B65B 55/20 493/25
8,155,775 B2 * 4/2012 Batchelder ..... B65D 81/113 264/308
8,234,844 B2 8/2012 Davlin et al.
8,340,812 B1 12/2012 Tian et al.
8,560,461 B1 10/2013 Tian et al.
8,639,472 B2 1/2014 Barlow et al.
8,683,777 B2 4/2014 Armington et al.
8,720,691 B2 5/2014 Hu
8,726,802 B2 5/2014 Senda et al.
8,777,008 B2 7/2014 Hu
9,248,611 B2 * 2/2016 Divine et al. ..... B29C 67/0088
2002/0002811 A1 * 1/2002 Weder et al. ..... B65B 55/20 53/474
2003/0200111 A1 10/2003 Damji
2004/0262187 A1 12/2004 Schauer
2005/0139509 A1 6/2005 Bussey, Jr. et al.
2006/0127648 A1 * 6/2006 De Luca ..... B65D 81/113 428/174
2010/0064907 A1 3/2010 Niizuma
2011/0186474 A1 * 8/2011 Weder ..... B65D 81/09 206/594
2011/0197550 A1 * 8/2011 Carlson et al. ..... B65B 55/20 53/472
2011/0308204 A1 * 12/2011 Corradi et al. ..... B65B 55/20 53/472
2012/0090482 A1 4/2012 Kohno et al.
2013/0152511 A1 6/2013 Derby
2013/0247519 A1 9/2013 Clark et al.
2013/0291614 A1 11/2013 Ichijo et al.
2014/0067104 A1 3/2014 Osterhout
2014/0069163 A1 3/2014 Nojiri et al.
2014/0208964 A1 7/2014 Kohno et al.
2015/0145158 A1 * 5/2015 Levine et al. ..... B29C 67/0085 264/40.1

FOREIGN PATENT DOCUMENTS

DE 102011055455 A1 * 5/2013 ..... B65B 61/22
EP 0250389 A1 * 12/1987 ..... B65D 81/113
GB 2472434 9/2011
KR 2010-0075150 7/2010
WO WO 2007015681 A1 * 2/2007 ..... B65D 81/113
WO WO 2013/144036 10/2013

* cited by examiner

ADHERING MODULAR ELEMENTS FOR PACKAGING STRUCTURES

BACKGROUND

Unless otherwise indicated herein, the materials described in this section are not prior art to the claims in this application and are not admitted to be prior art by inclusion in this section.

Order fulfillment generally involves receiving, processing, and shipping orders for goods to purchasers or other recipients. Orders may be business-to-business orders or direct-to-consumer orders, among other possibilities. When an order is received, the goods are retrieved from a point of storage, e.g., a warehouse, for packaging. A container is selected, the goods are placed in the container, and the container is filled with cushioning material to protect the goods during shipment. Common types of cushioning material include air cushions (e.g., seal plastic bags filled with air), bubble wrap, paper cushioning (e.g., crumpled paper), cellulose wadding, and foam packing peanuts.

Conventional approaches to packaging goods for an order are inefficient and often ineffective. In particular, a conventional packaging process typically requires excessive and wasteful amounts of cushioning material. In addition, to provide the desired amount of cushioning, many conventional approaches require large volumes of cushioning material and a larger container, thereby increasing the amount of cost and effort to handle and ship the container. Moreover, even if the space in a container is filled with cushioning material, the cushioning material may not prevent the goods from shifting in the container and becoming damaged during shipment. Indeed, the packaging process itself may result in damaging the goods. For example, filling the remaining space in a container with packing peanuts after goods have been placed in the container may apply forces that may damage the goods.

SUMMARY

An automated packaging manufacturing system can produce custom protective structures for positioning and protecting order items in a container according to a custom packaging specification. For example, a packaging optimization module can determine the custom packaging specification after an order is received, so that the custom packaging specification can provide a packaging arrangement based on the actual combination of items in the order. Correspondingly, the automated packaging manufacturing system can produce custom protective structures after the order is received and when the custom packaging specification is ready. To provide prompt shipment of the order, manufacturing of the custom protective structures is preferably completed by the time that the items have been assembled and are ready for packing. In other words, rapid manufacturing of the one or more protective structures occurs while the items are simultaneously retrieved from inventory storage and assembled at a packing location.

To achieve the rapid manufacturing of custom protective structures, the automated packaging manufacturing system can manufacture a protective structure from a plurality of modular elements. The modular elements are readily and rapidly assembled to form a shape that allows items to be packaged according to the custom packaging specification determined from an analysis of the items. Each modular element acts as a single building block for the protective structure. The automated packaging manufacturing system can manipulate each modular element to build a custom shape for the protective structure. Advantageously, because each modular element can be separately manipulated, the amount of material used to form each protective structure can be closely controlled to reduce waste of the material, shipment weight, costs, etc.

The modular elements can adhere to each other to form shapes that can support packaged items during shipment, while also absorbing any shocks, impacts, vibrations, or other external forces that may damage the packaged items. In other words, the adhesion between the modular elements is strong enough, so that the resulting protective structure can maintain the custom shape set forth by the custom packaging specification.

According aspects of the present disclosure, a method for on-demand packaging of one or more items includes receiving a request to package one or more items, and in response to receiving the request, determining characteristic data for the one or more items, the characteristic data including an indication of a volume of each item. The method also includes determining one or more containers for packaging the one or more items based at least on the volume of each item. In addition, the method includes determining an arrangement of the one or more items in the one or more containers. Further, the method includes determining one or more protective structures including one or more features configured to position the one or more items in the one or more containers according to the arrangement. Moreover, the method includes determining relative positions for a plurality of self-adhering modular elements to form the one or more protective structures with the one or more features. The method includes receiving subsets of the plurality of self-adhering modular elements. The method also includes depositing the subsets of the plurality of self-adhering modular elements to corresponding relative positions to form at least one of the protective structures. The self-adhering modular elements adhere to each other as the subsets of self-adhering modular elements are deposited and the self-adhering modular elements come into contact with each other. In addition, the method includes packaging the one or more items in the one or more containers with the one or more protective structures to position the one or more items in the one or more containers according to the arrangement.

According to aspects of the present disclosure, a method for on-demand packaging of at least one item includes receiving a request to package one or more items, and in response to receiving the request, determining characteristic data for the one or more items, the characteristic data including an indication of a volume of each item. The method also includes determining one or more containers for packaging the one or more items based at least on the volume of each item. In addition, the method includes determining an arrangement of the one or more items in the one or more containers. Further, the method includes determining one or more protective structures including one or more features configured to position the one or more items in the one or more containers according to the arrangement. Moreover, the method includes determining relative positions for a plurality of modular elements to form the one or more protective structures with the one or more features. The method includes receiving subsets of the plurality of modular elements including an unactivated adhesive material applied thereto. The method also includes depositing the subsets of the plurality of modular elements to corresponding relative positions to form at least one of the protective structures. In addition, the method includes activating the unactivated adhesive material on the subsets of modular elements to cause the plurality of modular elements to adhere to each other while disposed in the relative positions. Further, the method includes packaging the one or more items in the one or more containers with the one or more protective structures to position the one or more items in the one or more containers according to the arrangement.

According to aspects of the present disclosure, a system for manufacturing packaging includes a computing system configured to execute instructions stored on computer-readable media. The instruction causing the computing system to: receive a request to package one or more items; in response to receiving the request, determine characteristic data for the one or more items, the characteristic data including an indication of a volume of each item; determine one or more containers for packaging the one or more items based at least on the volume of each item; determine an arrangement of the one or more items in the one or more containers; determine one or more protective structures including one or more features configured to position the one or more items in the one or more containers according to the arrangement; determine relative positions for a plurality of modular elements to form the one or more protective structures with the one or more features. The system also includes a source for the plurality of modular elements. In addition, the system includes a feeder coupled to the computing system and the source. The feeder includes an array of one or more chambers. The one or more chambers receive a subset of the plurality of modular elements. The feeder is configured to position the array to deposit the subset of modular elements into the respective relative positions to form at least one of the protective structures.

These as well as other aspects, advantages, and alternatives, will become apparent to those of ordinary skill in the art by reading the following detailed description, with reference where appropriate to the accompanying drawings.

Figure 1:
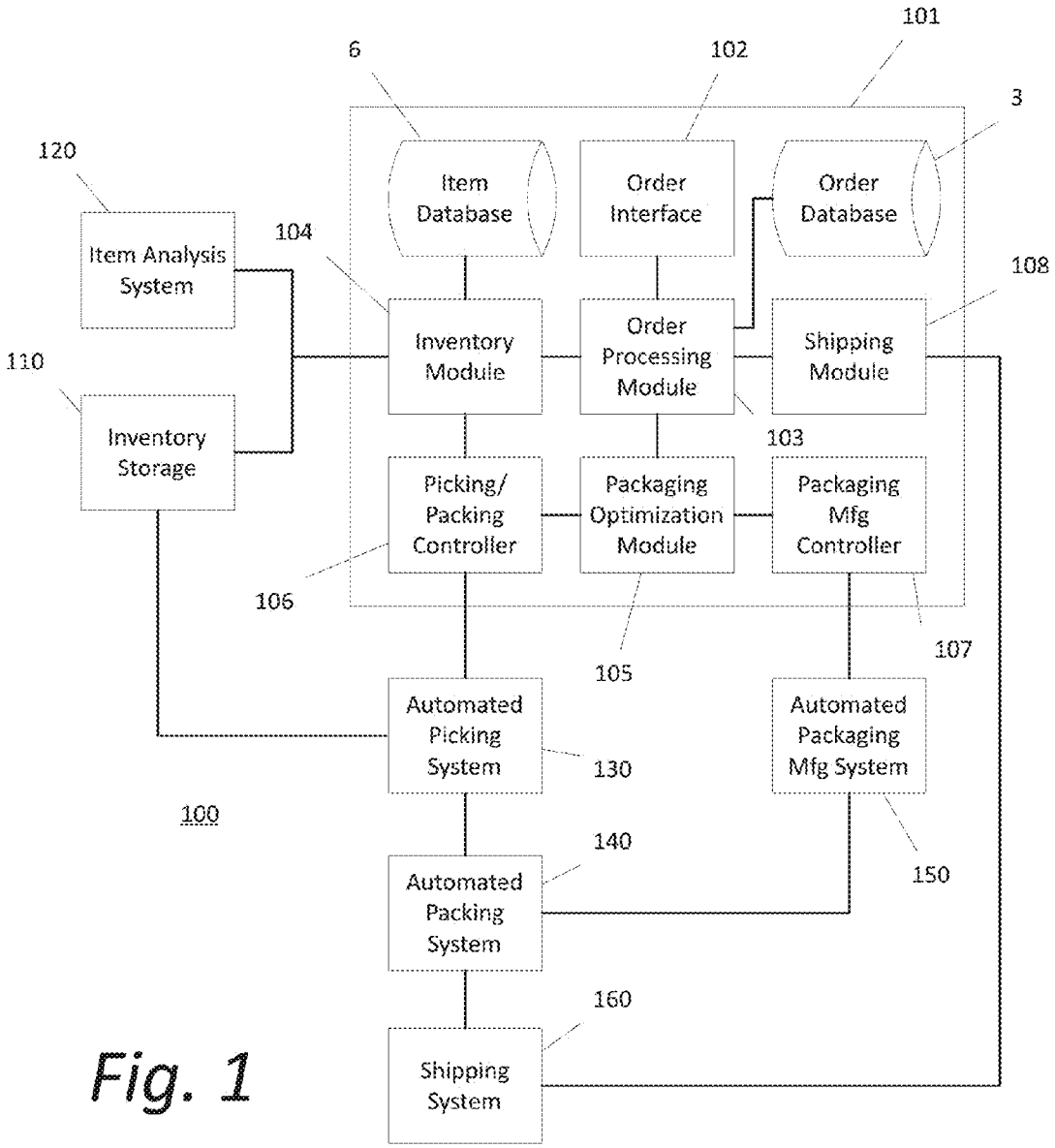
FIG. 1 illustrates an example order system for processing an order for one or more items, according to aspects of the present disclosure.

While the invention is susceptible to various modifications and alternative forms, specific embodiments have been shown by way of example in the Figures and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims. It should be understood that other embodiments may include more or less of each element shown in a given Figure. Further, some of the illustrated elements may be combined or omitted. Yet further, an example embodiment may include elements that are not illustrated in the Figures.

DETAILED DESCRIPTION

The following detailed description describes various features and functions of the disclosed systems and methods with reference to the accompanying figures. In the Figures, similar symbols typically identify similar components, unless context dictates otherwise. The illustrative system and method embodiments described herein are not meant to be limiting. It will be readily understood that certain aspects of the disclosed systems and methods can be arranged and combined in a wide variety of different configurations, all of which are contemplated herein.

I. Overview

Aspects of an order processing system employ an automated packaging manufacturing system for rapid on-demand creation of customized protective structures. These customized protective structures are configured to arrange and protect specific (e.g., unique) combinations of items packed inside a container (e.g., box, crate, etc.). The automated packaging manufacturing system, for example, may be employed by an order processing system in a retail shipping/distribution facility.

When an order is received, the order processing system analyzes the order to identify the items in the order and to determine any number of characteristics about each item, including, but not limited to, shape, size, weight, center of mass, shear strength, bending strength, compression strength, hardness/softness, solid/liquid, material composition, fragility, value, and special handling/packing instructions. Evaluating these characteristics, the order processing system determines a more optimal way to package the items, including, but not limited to: (i) what type of containers to use; (ii) how many of each container type to use; (iii) what items to place in each container; (iv) how the items should be arranged and oriented in each container relative to each other and to the container; and (iv) how a protective structure for each container should be formed to meet the specifications of the arrangement. In addition, the protective structure for each container may be designed in an effort to employ a reduced (and potentially minimal) amount of material and to reduce (and potentially minimize) the volume of the container.

Once the more optimal arrangement of the items in each container is determined, the automated packaging manufacturing system makes one or more custom protective structures for receiving and positioning the items in the container according to the planned arrangement. The protective structures can be formed with specific shapes and sizes according to the planned arrangement. The protective structures may include one or more positioning/retaining features that engage the items and hold them securely in position inside the three-dimensional space of the container. For example, the positioning/retaining features may include recesses and/or cavities that are shaped to receive the items. In addition, the protective structures can be shaped to accommodate the interior shape of the container. In general, the protective structures provide sufficient support so that the items can maintain their positions in the container according to the planned arrangement, while also absorbing any forces that may otherwise damage the items.

According to the present disclosure, the automated packaging manufacturing system assembles a plurality of modular elements to form a protective structure that allows the items to be packaged according to an arrangement determined from the analysis of the order. Each modular element acts as a single building block for the protective structure, and the automated packaging manufacturing system can manipulate each modular element, e.g., via machine/robotic device, to build a custom shape for the protective structure. In one aspect, the modular elements are assembled according to a voxel-based analysis to define the protective structure.

After an order is received, rapid manufacturing of the one or more protective structures may occur while other aspects of the order processing occur simultaneously (e.g., while the items are being retrieved from inventory storage and assembled at a packing location). The one or more protective structures are formed after the order is analyzed to optimize packaging and is ready when the items have been assembled for packing. The dynamic nature of the order processing system allows optimized packaging of different orders, which may include any combination and number of different items. As such, the order processing system can advantageously handle large volumes of mixed-SKU orders.

In one non-limiting example, a first order includes two coffee mugs and a second order includes four glasses. The same order processing system can dynamically determine a unique packaging configuration for each order where, for example, a first protective structure has two internal cavities shaped to receive the two coffee mugs and a second protective structure has four internal cavities shaped to receive the four glasses. Additionally, for example, the system may determine that the glasses are more fragile than the coffee mugs, so the second protective structure may utilize more material to provide extra protection as compared to the first protective structure. Because the order processing system dynamically determines the specifications for the packaging scheme after the order is received, the packaging scheme can be optimized for the particular combination of items that is specified in the order. For example, the packaging scheme can optimize the arrangement (i.e., positioning and orientation) of the items relative to each other.

Order processing systems according to the present disclosure have advantages over other systems that use a generic packing material (e.g., packing peanuts) to fill unused space in the container but fail to keep the items securely in position for an optimal arrangement. Custom protective structures according to the present disclosure can also be optimized to minimize the amount of packaging material used in the container. The disclosed order processing systems also have advantages over systems that use the actual items to shape packaging material. For example, other order processing systems may provide shaped packaging materials by spraying or otherwise applying material (e.g., a foam) directly to the items once they are placed in the container, posing the risk of breaking or damaging the items.

Aspects of the order processing system according to the present disclosure can be partially or wholly implemented under automatic computer/machine control. For example, one or more computers and/or machines (e.g., robotic devices) can be employed to receive an order, determine a more optimal way to package the items, determine optimal configuration(s) for protective structure(s), manufacture the protective structure(s), and pack the items with the protective structure(s) in the container(s).

II. Example System and Method

FIG. 1 illustrates an example order system 100 for processing an order for one or more items. Aspects of the order system 100 employ an automated system for manufacturing protective structures that are used to arrange the items in one or more containers and to protect the items during shipment. In some cases, a business may implement the order system 100 to ship items to outside customers, which may include consumers and/or other businesses. Additionally or alternatively, the order system 100 may be implemented to send items internally between departments, divisions, subsidiaries, etc., within the same business. In general, however, an order refers to any type of request that results in the movement of one or more items between two locations, regardless of the entity or entities involved with the request.

In some cases, a business may produce some or all of the items in an order. Additionally or alternatively, the business may obtain some or all of the items in an order from another source. In general, the items in an order may include any number and combination of physical objects having different characteristics. With on-demand manufacturing of customized packaging, the order system 100 can provide protective structures for the particular combination of items in an order, regardless of the number of items and the varying characteristics of the items. Moreover, as described further below, the order system 100 determines a customized packaging scheme that can maximize protection for the items while also satisfying other requirements for the packaging.

The order system 100 includes a computing system 101 that manages aspects of the order processing. The computing system 101 includes an order interface 102 through which orders can be received for processing. The order interface 102 may be communicatively coupled to an order entry system (not shown) that receives orders. In some cases, sales personnel may enter orders from customers into the order entry system. Additionally or alternatively, outside customers may enter some or all orders directly into the order entry system. The order entry system, for example, may include order entry screens on a website and/or a software application provided by a business. The order entry screens may be accessible via any personal computing device such as, for example, a mobile phone, a laptop computer, a desktop computer, a tablet computer, etc.

The order system 100 includes various modules that can process the information in the orders received through the order interface 102. In addition, the order system 100 includes various controllers that can control aspects of physical systems that manufacture the customized packaging for each order and that pick, pack, and ship items for each order. Aspects of these modules and controllers can be described with additional reference to the flowchart illustrated in FIG. 2.

Figure 2:
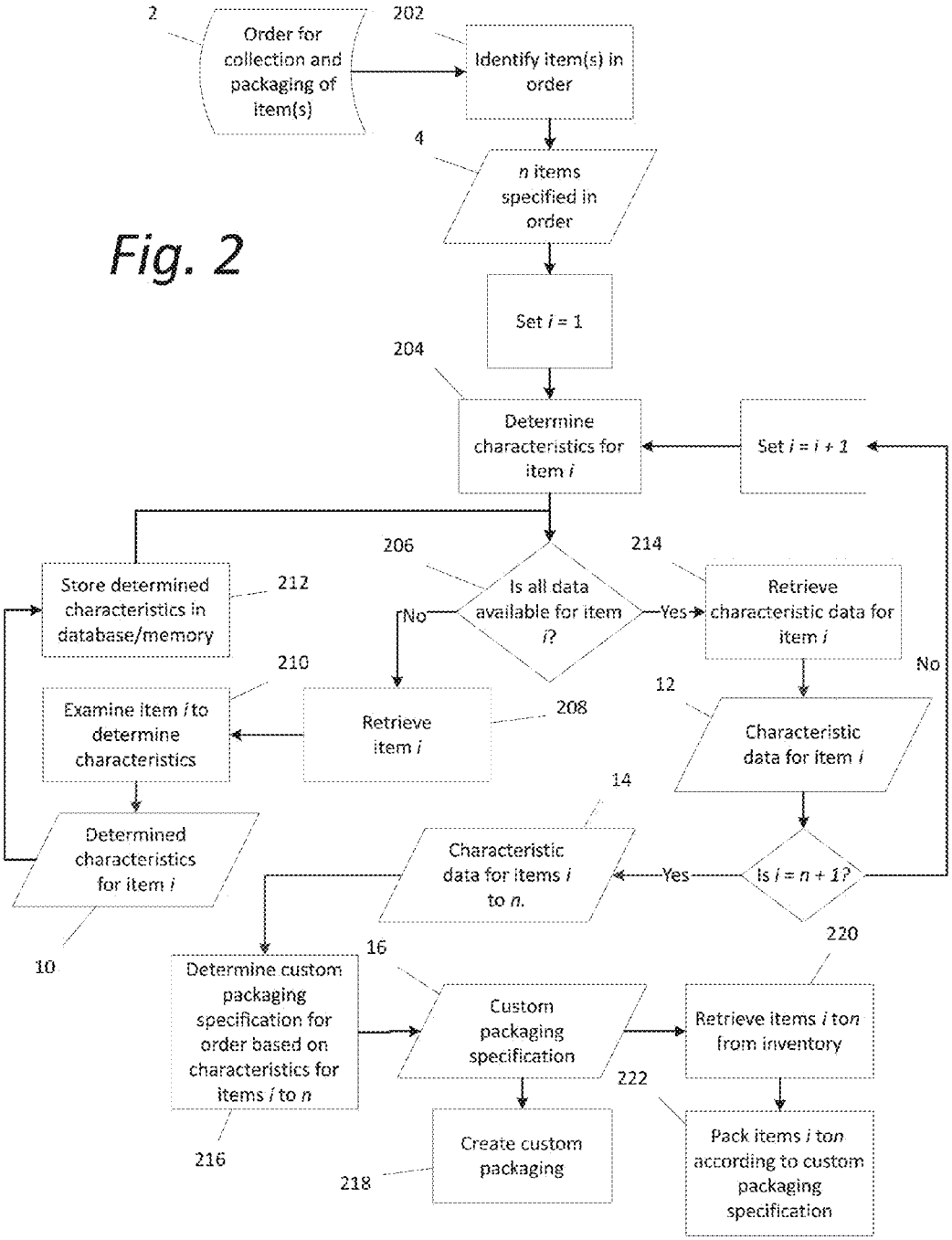
FIG. 2 illustrates a flowchart for an example approach for processing an order, according to aspects of the present disclosure.

The order interface 102 can receive an order 02 as shown in FIG. 2. The processing of order 02 involves retrieving items specified in the order 02 and packing the specified items in custom protective structures. The information in the order 02 is passed to an order processing module 103, which according to act 202 identifies a list 04 specifying quantities of n items i for the order 02.

As described in more detail below, to determine a customized packaging scheme for the order 02, the order system 100 considers various characteristics for each item i. An item database 06 stores data for a catalog of items that may be specified in an order 02, and an inventory module 104 maintains the item data in the database 06. The item data includes various characteristics for each item in the catalog. For example, such characteristic data may include, but is not limited to, shape, size, weight, center of mass, shear strength, bending strength, compression strength, hardness/softness, solid/liquid, material composition, fragility, and value of an item. Therefore, according to act 204, the inventory module 104 receives the list 04 of item(s) i specified in the order 02 and can query the database 06 for characteristic data for each item i.

For each item i among the n items, the inventory module 104 determines at decision 206 whether the database 06 stores all desired characteristic data on the particular item i. Characteristic data on the particular item i may be recorded in the database 06 in advance so that the characteristic data is readily available when an order 02 for the particular item i is received. In some cases, at least some of the characteristic data may be determined in advance by administrators of the order system 100. Additionally or alternatively, at least some of the characteristic data may be provided in advance by a manufacturer or supplier of the particular item i. If the database 06 does include all desired characteristic data on the particular item i in advance, the desired characteristic data is readily retrieved from the database 06 according to act 214.

If, however, all desired characteristic data on the particular item i is not available in the database 06, the order system 100 can actively determine unknown characteristics in some embodiments. Specifically, according to acts 208 and 210, the particular item i can be retrieved and examined in an item analysis system 120. The item analysis system 120, for example, may provide an examination station where personnel and/or machines can examine the item i closely and record the characteristic data in the item database 06 or other memory according to act 212. The item analysis system 120 may include various tools for determining the characteristic data. For example, the item analysis system 120 may include measurement tools, such as rulers, scales, scanning devices, imaging devices, etc., for determining the size, shape, weight, etc., of an item.

In one non-limiting example, the item analysis system 120 can be operated by personnel of a manufacturer, retailer, and/or warehouse. In another non-limiting example, the item analysis system 120 can be included in a shipping kiosk (not shown) configured to receive an order 02 from a shipping customer (e.g., a stand-alone kiosk where the customer can drop of an item for on-demand, custom packaging and shipping). In yet another non-limiting example, personnel can additionally or alternatively manually enter qualitative data (e.g., fragility assessment) or non-physical data (e.g., monetary value) through the item analysis system 120.

Because the order system 100 can determine characteristic data dynamically after an order 02 is received, the order system 100 can accommodate orders 02 for items that are custom designed, configured according to particular specifications in the order 02, or otherwise made-to-order. In other words, the order system 100 can take orders 02 for items with characteristic data that can only be determined after the order 02 is placed. For example, the order system 100 can receive orders 02 for one-of-a-kind artwork or jewelry, custom-designed furniture, specially tailored clothing, etc. Once the characteristic data 10 is determined according to the acts 208 and 210, the determined characteristic data 10 is stored in database 06 or other memory in act 212.

Recording the determined characteristic data 10 in the database 06 allows such data to be available for subsequent orders 02, so that acts 208, 210, and 212 do not have to be subsequently repeated. For example, the characteristic data 10 can include identification information (e.g., a barcode, a serial number, a QR code, an image, a text-based description, etc.) that allows the system to identify the characteristic data 10 stored in the database 06 that is associated with items in subsequent orders 02. In this way, the order system 100 can be configured to continuously learn about new items as orders 02 are received.

Although the embodiment of FIG. 2 allows characteristic data to be determined dynamically after an order 02 is received, it is understood that alternative embodiments may be more highly automated, and as such, all desired characteristic data 12 for a particular item is recorded in the database 06 before an order 02 for the particular item can be received by the order system 100.

Once all desired characteristic data 12 for each item i is retrieved according to act 214, a packaging optimization module 105 processes a combination 14 of the characteristic data 12 and determines a custom packaging specification 16 according to act 216. The custom packaging specification 16 produced by act 216 is then passed to an automated packaging manufacturing system 150. Using the custom packaging specification 16, the automated packaging manufacturing system 150 makes one or more protective structures that are employed to position and protect the items i in one or more respective containers for shipping the order 02. As described in detail further below, the custom packaging specification 16 provides a more optimized approach for arranging the items i three-dimensionally in the shipment containers. The protective structures provide sufficient support to keep the items i in position during movement of the shipment containers, while also absorbing any shocks, impacts, vibrations, or other external forces that may damage the items i.

To produce the custom packaging specification 16, the packaging optimization module 105, for example, may analyze the three-dimensional aspects of the protective structures and the containers according to voxel-based approaches. A voxel describes a three-dimensional volumetric pixel, which can be used to break down any geometry according to any desired resolution or scale. Voxel-based approaches strike a balance between practical manufacturing and material optimization, based on the requisite structural properties.

Any number of criteria can be employed to determine the custom packaging specification 16. The packaging optimization module 105 can take the particular characteristic data of each item i into account. In addition, the packaging optimization module 105 can also consider how the particular combination of quantities of the items i can be optimally packaged. For the combination, the packaging optimization module 105 may determine: (i) what type of containers to use; (ii) how many of each container type to use; (iii) what items to place in each container; and (iv) how the items should be arranged and oriented in each container relative to each other and to the container. Furthermore, the packaging optimization module 105 may consider other aspects of the order 02. For example, the custom packaging specification 16 may take shipment specifications, e.g., distance of shipment, location of recipient, type of shipping vessel (e.g., ground, air, water), environmental conditions during shipment, etc., into account.

A more optimal packaging scheme, for example, may among other considerations:

- use less space for packaging;
- use less packaging material;
- orient the items to maximize use of the container space;
- facilitate package handling by distributing mass of different items more evenly inside the container or lowering the center of gravity or the center of mass inside the container;
- position less valuable items around the periphery of more valuable items;
- strategically enhance protection for more fragile items while providing less protection for less fragile items;
- configure packaging for shipment specifications, e.g., by configuring according to the distance of shipment, location of recipient, type of shipping vessel (e.g., ground, air, water), environmental conditions during shipment, etc.
- facilitate removal of the items by the package recipient;
- present the items to the recipient according to a particular aesthetic scheme (e.g., branding strategy); and/or
- respond to feedback from past recipients regarding possible improvements to packaging, including feedback on items that were damaged during shipment.

Because the custom packaging specification 16 is determined after the order 02 is received, the custom packaging specification 16 can be dynamically customized to account for aspects that may not be known until after the order 02 is placed. For example, the inventory module 104 may determine that a quantity of an item in the order 02 is not in stock, e.g., in the inventory storage 110. As such, the unavailable item may be shipped separately from the rest of the order 02. Responding dynamically to changing inventory levels, the packaging optimization module 105 determines a custom packaging specification 16 that only has to accommodate items that are actually available and that can be included in the present shipment. Designing the packaging before the order 02 is placed (or before available inventory is determined) might otherwise result in manufacturing packaging for items that are not even available for shipment.

While the automated packaging manufacturing system 150 makes the protective structure(s) according to the custom packaging specification 16, an automated picking system 130 acts in parallel to retrieve the items i from inventory storage 110, according to act 222. The computing system 101 includes a picking/packing controller 106 that controls aspects of the automated picking system 130. To enhance efficiency, rapid manufacturing allows the protective structure(s) to be completed or substantially completed during the time generally required to complete the picking process. As such, the protective structure(s) are available (with no delay or with minimal delay) when the items i are ready for packing.

Once the items i have been retrieved, the picking/packing controller 106 causes an automated packing system 140 to pack the items i in the container(s) with the protective structure(s) according to act 224. In particular, the custom packaging specification 16 is employed to direct the automated packing system 140 how each item i should be packed in the custom protective structure(s). If the custom packaging specification 16 designates that the items i are to be shipped in more than one container, the automated packing system 140 packs each subset of items i with its designated protective structure(s) in its designated container. The automated packing system 140 ensures that the subset of items i are properly combined with the protective structure(s) so that they are arranged in the three-dimensional space of the container according to the optimized packaging scheme. In some cases, the automated packing system 140 can move with one or more degrees-of-freedom to manipulate each item i so that the item i is properly placed in the protective structure(s) and/or properly oriented relative to the container and other items i.

The automated picking system 130 and the automated packing system 140 allow some or all aspects of the picking process of act 222 and the packing process of act 224 to be generally achieved without manual input or human intervention. For example, the automated picking system 130 and the automated packing system 140 may employ the picking/packing controller 106 and the packaging manufacturing controller 107, respectively, to control machines, robotic devices, conveying devices, etc., to physically move and manipulate the items i, the protective structures, the containers. and related objects.

Once the automated packing system 140 assembles the items i with the respective protective structures and containers, the containers are prepared for shipment by a shipping system 160. The shipping process can be handled by a shipping module 108 in the computing system 101. For example, the shipping module 108 can prepare shipping documents, schedule delivery of the packaged items i, track delivery, etc. In one example implementation, the shipping module 108 can interface with a package delivery service such as GOOGLE EXPRESS to facilitate same-day delivery of the assembled package to the recipient and/or delivery during the recipient's preferred delivery time window.

As described, the order system 100 illustrated in FIG. 1 includes a computing system 101 to handle aspects of the order process illustrated in FIG. 2. In particular, the computing system 101 includes the order interface 102, the order processing module 103, the inventory module 104, the packaging optimization module 105, the picking/packing controller 106, the packaging manufacturing controller 107, and the shipping module 108. In some cases, the order processing module 103 can manage the other components of the computing system 101 and can coordinate the exchange of data between the various components. The components of the computing system 101 shown in FIG. 1 may represent separate structural and/or logical components. Although the computing system 101 can include the separate components as shown in FIG. 1, it is understood that the components of a computing system 101 can be structurally and/or logically combined, configured, and/or organized in any manner to achieve the functions of an order system 100 according to the present disclosure.

III. Packaging Determination & Optimization

As described above, after all of the characteristic data 14 is retrieved, the packaging optimization module 105 determines a custom packaging specification 16 for creating an on-demand, order-specific packaging of the one or more items i at act 216. The packaging specification 16 can be characterized by, for example, one or more container parameters relating to a container in which the item(s) i will be packaged, one or more arrangement parameters relating to an arrangement for positioning the item(s) i within a three-dimensional space of the container, and one or more protection parameters relating to a protective structure for protectively retaining the item(s) i in the container according to the arrangement.

The container parameter(s) indicate which of a plurality of potential containers is to be utilized by the automated packing system 140 for packing the one or more items i. The potential containers can have, for example, different materials, volumes, dimensions, shapes, and/or sealing mechanisms (e.g., tape, slots and tabs, adhesive, etc.). Additionally or alternatively, for example, the potential containers can have a variety of different construction types (e.g., single face, single-wall, double-wall, etc.), material thicknesses (e.g., flute sizes), and/or performance characteristics (e.g., burst strengths, edge crush strengths, stacking strengths, compression strengths, flat crush characteristics, water resistances, electromagnetic insulation characteristics, temperature insulation characteristics, surface treatments, coatings, etc.). Accordingly, the container parameters can indicate, for example, a type of container (e.g., a material, a thickness, a shape, a volume, dimensions, a sealing mechanism, a construction type, performance characteristics, etc.) and a quantity of containers for packaging the one or more items i according to the packaging specification 16.

Non-limiting examples of materials that can be utilized for the containers include paperboard, plastic, corrugated fiberboard (i.e., cardboard), wood, metal, combinations thereof, and/or the like. According to some aspects, the potential containers can include various different standard-sized boxes that are commonly used for shipping such as, for example, cuboid shaped boxes. According to additional and/or alternative aspects, the plurality of potential containers can include containers having non-standard sizes and shapes such as, for example, irregularly shaped containers (e.g., cylindrical, heart-shaped, triangular pyramid, cone, etc.) or asymmetrically shaped containers. Additionally, for example, one or more of the plurality of potential containers can be configured to contain the item(s) i in a wrap-like manner (e.g., a stretch wrap or a shrink wrap). In general, the container(s) provide a three-dimensional space in which the one or more items i can be held and transported.

The arrangement parameters indicate an arrangement, which is a positioning for each of the one or more items i within the three-dimensional space defined by the container(s) (i.e., an interior space of the container(s)). If, for example, the quantity of containers is greater than one, the arrangement parameters can further include an indication as to which of the one or more items i will be placed in which of the containers.

Figure 3A:
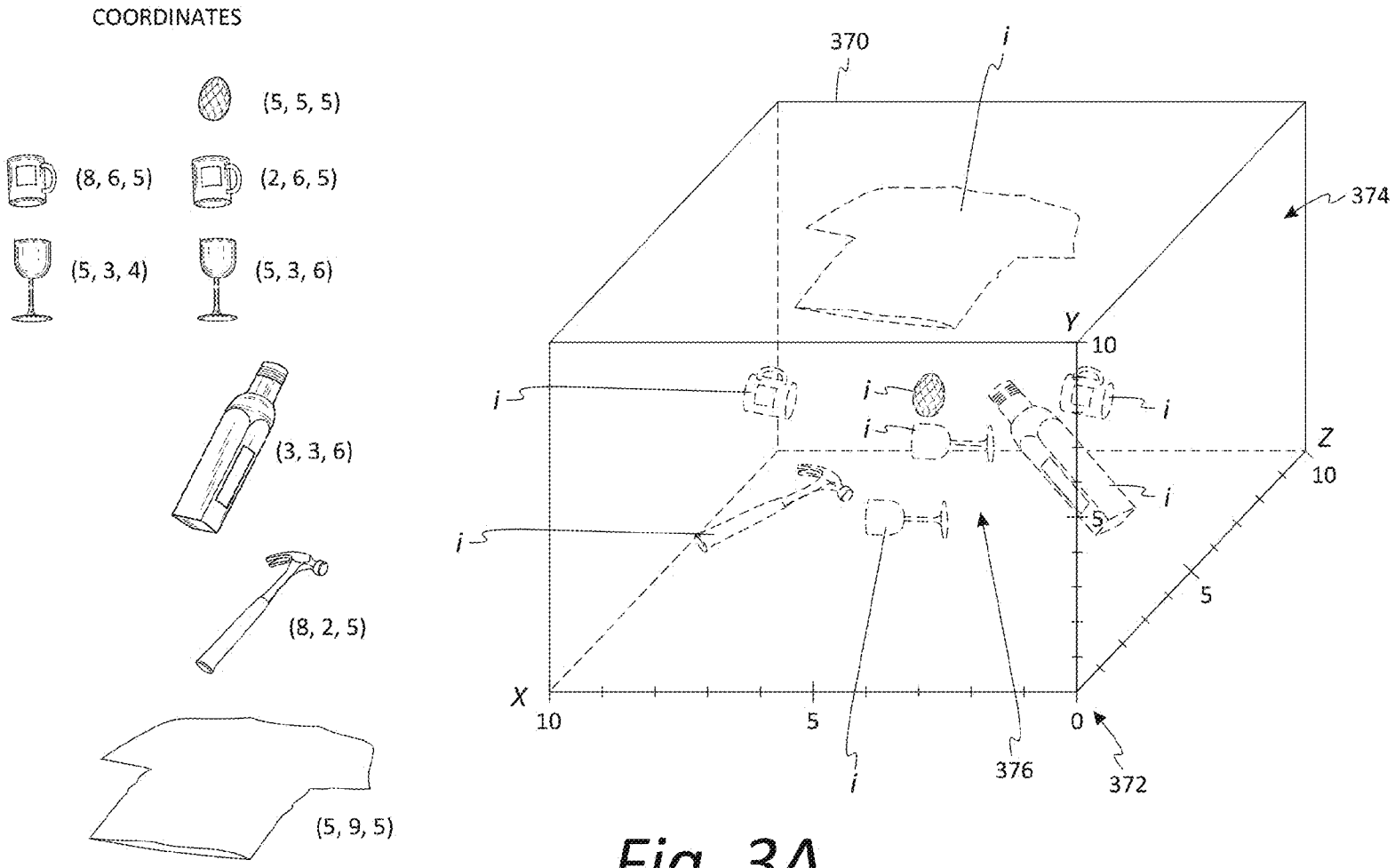
FIG. 3A illustrates an example arrangement of items, according to aspects of the present disclosure.

According to some aspects of the present disclosure, a coordinate system (e.g., a Cartesian coordinate system) can be employed to provide a frame of reference for indicating the relative positions (i.e., locations and/or orientations) of the one or more items i with respect to each other and the interior space of the container. FIG. 3A illustrates an example container 370 having an example coordinate system 372 assigned to an interior space 374 of the container 370 (i.e., a container volume 374). As shown in FIG. 3A, a lower corner of the container 370 is located at an origin of the coordinate system 372 with an x-axis extending along a length of the container 370, a y-axis extending along a height of the container 370, and a z-axis extending along a width of the container 370.

As further shown in FIG. 3A, one or more items i are arranged in an example arrangement 376 within the container 370. Each of the one or more items i can be associated with one or more three-dimensional coordinates to indicate the respective portions of the interior space 364 that will be occupied by the one or more items i when positioned in the container 370 according to the arrangement 376. In this way, the packaging optimization module 105 can precisely determine the positioning of each of the one or more items i within the container 370. In some example implementations, the arrangement parameters can be used to communicate the coordinate information to the automated packing system 140, which can utilize the coordinate information to physically place the item(s) i into the proper positions within the container 370 and the protective structure.

According to some aspects of the present disclosure, the coordinate system 372 can also be used to spatially map the characteristic data 14 of the items i to the interior space 364 of the container 370. For example, a three-dimensional data model can be determined for each item i based on the characteristic data 14 relating to the size, shape and/or dimensions. Using a computer-based simulation, the packaging optimization module 105 can spatially map the data model to the coordinate system 372 to determine the portion of the interior space 364 that is to be occupied by the item i when positioned in the container 370 according to the arrangement 376.

According to additional and/or alternative examples, other characteristic data 14 associated with the one or more items i can be mapped to the interior space 364 and the coordinate system 372. For example, the characteristic data 14 (or data models based thereon) relating to a value, a weight, a center of mass, a shear strength, bending strength, compression strength, a hardness/softness (e.g., a durometer value), a state of matter (e.g., solid, liquid, gas), a material composition, a fragility, information about nesting areas into which other items i may be nested, and other properties can be spatially mapped to the interior space 374 of the container 370 by the packaging optimization module 105. As will be described further below, such spatial mapping of the characteristic data 14 can be employed to improve or optimize the packaging specification 16 based on one or more enhancement criteria.

While the example illustrated in FIG. 3A includes a coordinate system 372 having an origin in a corner of a rectangular container 370, it should be understood that the container 370 can have any other shape or size and the origin of the coordinate system 372 can be located at other locations relative to the interior space 374 of the container 370 (e.g., a center of the container 370). Additionally, it should be understood that the x-, y-, and z-axes of the coordinate system 372 can be scaled differently and/or extend in directions other than those illustrated in the example of FIG. 3. Still further, although the illustrated example includes a Cartesian coordinate system 372, it is contemplated that other types of coordinate systems 372 (e.g., a polar coordinate system) can be used in other implementations.

Although a single coordinate point is indicated for each item i in FIG. 3A for clarity, it should be understood that each of the items i can be associated with a plurality of coordinates. According to additional or alternative aspects, the items i and the interior space 374 can be mapped using voxel-based data. In some instances, the resolution of the voxels can be based on the specific items i analyzed. For example, an item i with intricate features can be mapped with greater resolution than another item i having more general features.

The protection parameters indicate information related to the design and manufacture of a protective structure for protecting the one or more items i when positioned within the container 370 according to the arrangement 376. For example, the protective structure can provide both support to retain the items i in the positioning of the arrangement 376 and cushioning to protect the items i during shipment. The protection parameters are communicated to the automated packaging manufacturing system 150, which is configured to manufacture the custom-designed protective structure based on the protection parameters. In other words, the protection parameters enable the protective structure to be produced on-demand and in a customized manner in response to an analysis of the characteristic data 14 associated with the ordered items i. This is in contrast to other systems that select one standard protective structure from a plurality of predefined, standard protective structures (e.g., conventional bubble wrap, air pillows, packing peanuts, loose fill, etc.) based on a mere identification of an item i. The dynamic nature of the protective structures provides for improved or optimized packaging of different orders 02, which may include any combination and number of different items i.

Because the protective structures may be highly customized, the protection parameters can be configured to indicate information that facilitates the manufacture of a vast number of different, potential configurations for the protective structure. For example, the protection parameters can indicate a material composition, a material density, a size, a shape, and/or dimensions of a protective structure that can be manufactured by the automated packaging manufacturing system 150. Non-limiting examples of materials include polymeric foam (e.g., polystyrene, polypropylene, polyethylene, polyurethane, etc.), plastic, pulp, cardboard, compostable materials (e.g., starch-based materials, mushroom-based materials, etc.), bioplastics, fibrous materials, woven materials, other cushioning materials, etc. According to some aspects, the protective structure can be made from a single material. According to alternative aspects, the protective structure can be made from a plurality of materials. For example, the protective structure can be configured to be compliant in one or more select areas and rigid in other areas by forming the protective structure from different materials.

Figure 3B:
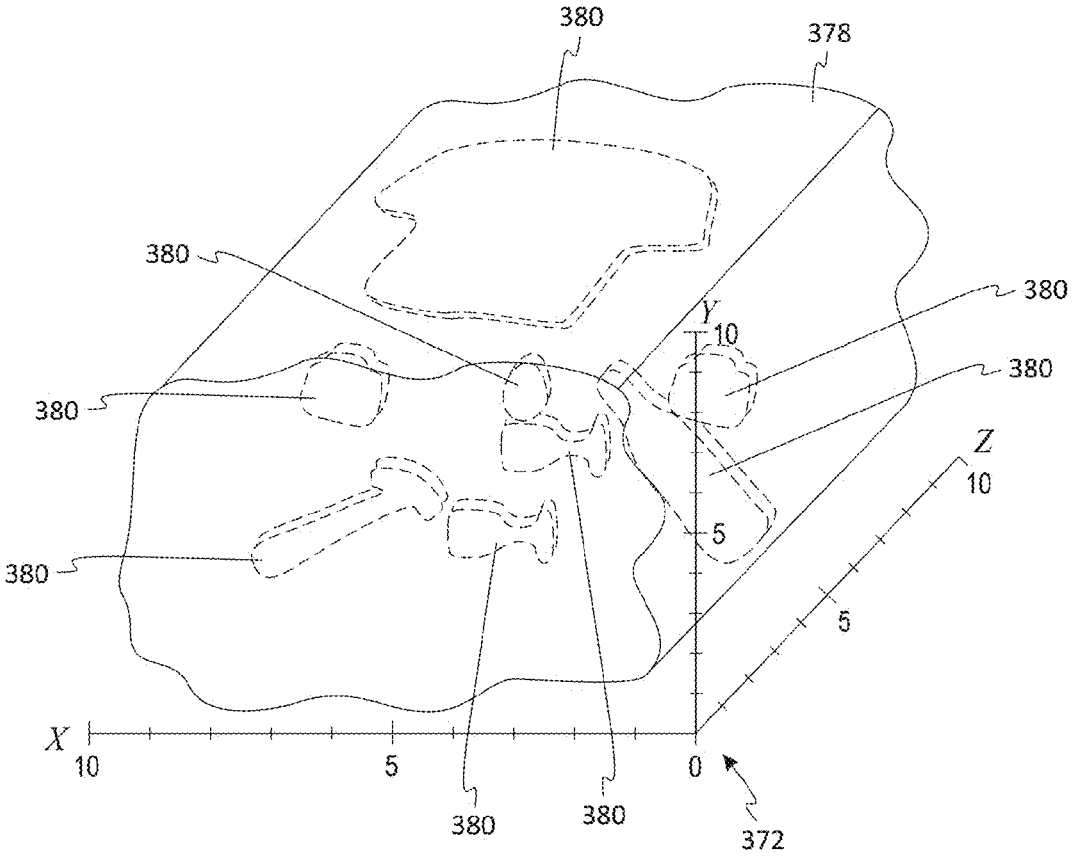
FIG. 3B illustrates an example protective structure for protecting and retaining the items according to the example arrangement of FIG. 3A.

FIG. 3B illustrates an example protective structure 378 including a plurality of cavities 380 for protecting and retaining the items i according to the example arrangement 376 illustrated and described above for FIG. 3A. It should be understood that the protective structure 378 of FIG. 3B is merely one example and that the customized protective structures 378 of the present disclosure can differ in any number of ways described above or below (e.g., a material composition, a material density, a size, a shape, dimensions, etc.).

The protective structure 378 can have a symmetric or an asymmetric shape. According to some aspects, an exterior shape of the protective structure 378 can generally correspond to an internal shape of the container 370. For example, an example protective structure 378 can have an exterior shape that is generally in the shape of a cube, which corresponds to a cube-shaped interior space 374 of an example container 370. According to other aspects, the exterior shape of the protective structure 378 can be different from the internal shape of the container 370. For example, the protective structure 378 can include a plurality of legs that each extend from a main body to a corner of a cuboid container 370. In some instances, the protective structure 378 can be configured to closely fit within the interior space 374 of the container 370 to mitigate impacts due to undesirable movement of the protective structure 378 relative to the container 370.

During shipping, the package may be subject to a number of impacts, vibrations, or other external forces that may potentially damage the one or more items i. To protectively retain the items i in the arrangement 376, the protective structure 378 includes one or more recesses and/or cavities 380 configured to receive the one or more items i according to the arrangement 376 (as shown, e.g., in FIG. 3B). According to some aspects of the present disclosure, each of the recesses and/or the cavities 380 can have a size and a shape that generally corresponds to the size and the shape of a respective one of the one or more items i. Additionally, for example, the recesses and/or the cavities 380 can be oriented according to an orientation of the one or more items i indicated by the arrangement parameters. As the arrangement 376 can include the same or different items i having the same or different shapes and sizes depending on the order 02, the recesses and/or the cavities 380 can be symmetrically or asymmetrically formed within the protective structure 378.

According to some aspects, the one or more recesses and/or cavities 380 are located within an interior of the protective structure 378. That is, the protective structure 378 can at least partially or fully enclose the one or more items i within the protective structure 378 on all sides of the one or more items i. In this way, the protective structure 378 can protect the one or more items i from shocks, vibrations, temperature, humidity, dust, insects, liquids, electrostatic shock, etc., in all six dimensions while at the same time retain the one or more items i in the desired arrangement 376.

It is contemplated that, according to other aspects, the protective structure 378 can additionally include one or more recesses externally located on the protective structure 378. That is, the externally located recesses can be configured so that an item i is not enclosed on all sides. For example, in some instances, an item i might not need to be protected by the protective structure 378 to the same extent as other items i. In such instances, the items i requiring less protection may be located externally on the protective structure 378 while the items i requiring greater protection may be located internally within the protective structure 378. As one non-limiting example, a protective structure 378 for packaging a porcelain figurine and a down coat can include an internal cavity 380 for fully enclosing the porcelain figurine within the protective structure 378 and an external recess for receiving the down coat on an exterior surface of the protective structure 378.

It is further contemplated that, according to additional or alternative aspects, the protective structure 378 can include features other than the recesses and/or cavities 380 for protectively retaining the items i. As non-limiting examples, the protective structure 378 can include one or more clips, rings, areas of increased material density, slots, interlocking geometries, etc for protectively retaining the items i. It is also contemplated that, according to additional or alternative aspects, the protective structure can have an exterior that is configured to withstand the rigors of shipment such that the items i can be transported in the protective structure 378 without a container 370.

In the example illustrated in FIG. 3B, each of the cavities 380 is configured to receive a respective one of the plurality of items i. According to additional or alternative aspects of the present disclosure, one or more of the cavities 380 can be configured to receive a plurality of the items i. For example, according to some aspects, at least two of the items i can be nested with each other in the arrangement 376 and received in a single recess or cavity 380 of the protective structure 378. That is, one item i may be positioned within a nesting area (e.g., a cavity or recess) of another item i. Whether the items i are nestable can be indicated in the characteristic data 14 or determined by the packaging optimization module 105 based on the characteristic data 14 (e.g., size, shape, or dimension information).

According to some aspects, the protective structure 378 can be a unitary structure. For example, the protective structure 378 can be configured as a clamshell-type structure that can be hingedly opened and closed to facilitate insertion and removal of the one or more items i from the one or more recesses and/or cavities 380. According to additional and/or alternative aspects, the protective structure 378 can be a multiple-part construction. For example, the protective structure 378 can include a plurality of separate pieces that can be stacked on top of one another or otherwise engaged to partially or fully enclose the one or more items i within the protective structure 378. In general, the protective structure 378 can have at least two portions that are couplable to form the protective structure 378 and facilitate insertion/removal of at least one of the one or more items i to/from an enclosed position within the protective structure 378.

According to some aspects of the present disclosure, the protective structure 378 can be spatially mapped to the interior space 374 of the container(s) 370 using the coordinate system 372 and/or voxel-based data described above. For example, the size, shape, and/or dimensions of the protective structure 378 can be mapped to the interior space 374 and the coordinate system 372 (e.g., via a data model of the protective structure 378). The coordinates and/or voxel-based data associated with the protective structure 378 can thus indicate the portions of the interior space 374 that will be occupied by the protective structure 378 when the protective structure 378 is positioned in the container 370.

According to some example implementations, the coordinate information and/or the voxel-based data associated with protective structure 378 can be included in the protection parameters and communicated to the automated packaging manufacturing system 150 to facilitate the manufacture of the protective structure 378. Additionally, for example, the coordinate information and/or the voxel-based data associated with the protective structure 378 and the arrangement 376 can be utilized by the packaging optimization module 105 to ensure that the one or more recesses and/or cavities 380 are consistent with the arrangement 376 of the one or more items i and vice versa (as shown, e.g., by FIG. 3A and FIG. 3B).

In addition to spatially mapping the size, shape, and/or dimensions of the protective structure 378, the coordinate system 372 can be employed to spatially map one or more protection characteristics of the protective structure 378 to the interior space 374 of the container 370. The one or more protection characteristics can include, for example, metrics for quantifying and/or characterizing an amount of protection provided by the protective structure 378 against shocks, vibrations, thermal effects, humidity effects, air pressure effects, dust, insects, liquids, static electricity, combinations thereof, and/or the like. The one or more protection characteristics can additionally or alternatively relate to, for example, an amount of resiliency (i.e., an capability to withstand multiple impacts) and/or an amount of resistance to creep (i.e., deformation under a static load) of the protective structure 378. Still further, the one or more protection characteristics can relate to other factors that may affect the processes for determining and/or evaluating a protective structure 378 such as, for example, a material cost, an environmental impact of the material, whether a material is out of stock, an amount of energy required to produce the protective structure, etc. By spatially mapping the one or more protection characteristics, informed decisions can be made as to the design and implementation of a protective structure 378 customized for a specific order 02 of the one or more items i.

As described above, the custom packaging specification 16 is determined based on the characteristic data 14 of the one or more items i. For example, the custom packaging specification 16 can include a protective structure 378 having recesses and/or cavities 380 that correspond to the shapes and sizes of the one or more items i indicated by the associated characteristic data 14. According to additional aspects of the present disclosure, the custom packaging specification 16 can be further determined by the packaging optimization module 105 by processing the characteristic data 14 using one or more design criteria that provide a framework for achieving desired packaging objectives. For example, the design criteria can include one or more enhancement criteria and/or one or more design constraints described further below. Additionally, for example, the one or more design criteria can define a set of relationships (e.g., if-then rules) between the characteristic data 14, the enhancement criteria, and/or the design constraint(s) (e.g., if the characteristic data 14 for an item i indicates that the item i is worth more than X dollars, then the packaging specification 16 is designed to protect the item i from an impact of at least Y force).

The enhancement criteria can be employed by the packaging optimization module 105 to custom design a more optimal custom packaging specification 16 for the specific collection of items i in the order 02. Non-limiting examples of enhancement criteria include packaging efficiency criteria, cost criteria, protection criteria, package handling criteria, and/or aesthetics criteria.

The packaging efficiency criteria can relate to an amount of material required to implement a custom packaging specification 16 (i.e., an amount of material for forming the container 370 and/or an amount of material for forming the protective structure 378). The packaging efficiency criteria can be thus utilized to reduce or minimize the amount of material required to package the one or more items i, which may reduce the costs and the environmental impact associated with packaging and shipping the one or more items i.

The cost criteria can relate to a cost associated with a custom packaging specification 16. For example, the cost criteria can be based on a cost of materials for the container(s) 370, a cost of materials for the protective structure(s) 378, one or more freight rates for shipping the assembled package (e.g., based on a size and/or a weight of the assembled packages), and/or an amount of time or resources (e.g., labor or machinery) required to assemble the package according to a particular custom packaging specification 16. The cost criteria can be thus utilized to reduce or minimize the cost associated with packaging and shipping the one or more items i.

The protection criteria can relate to an amount or a type of protection that is provided for each of the one or more items i due to the container(s) 370, the protective structure(s) 378, and/or the arrangement 376. For example, the protection criteria can relate to the protection provided by the custom packaging specification 16 for shocks, vibrations, thermal effects, humidity effects, air pressure effects, dust, insects, liquids, static electricity, combinations thereof, and/or the like. The protection criteria can additionally or alternatively relate to, for example, an amount of resiliency (i.e., a capability to withstand multiple impacts), an amount of resistance to creep (i.e., deformation under a static load), a burst strength, an edge crush strength, a stacking strength, a compression strength, flat crush characteristics, etc. The protection criteria can be thus utilized to improve or maximize the protection provided to the items i during shipping. In some embodiments, aspects of the protection criteria (as well as other criteria) can be determined from feedback received from past recipients. For example, past recipients may provide feedback regarding items that were damaged during shipment. Using this feedback, the protection criteria can be improved to provide more effective protection for the items. For example, it may be determined that certain items require more cushioning or need to be arranged away from the sides of the container in order to reduce damaging shocks during shipment.

The package handling criteria can relate to a distribution of weight and other stability aspects of the custom packaging specification 16. If the weight within the container 370 is too unevenly distributed (e.g., top heavy or side heavy), a package may be difficult to handle and more likely to be dropped. By more evenly distributing the weight of the one or more items i and/or the protective structure 378, the risk of damage may be reduced or mitigated. According to one non-limiting example, the package handling criteria can relate to a distance between a center of gravity of a package assembled according to the package specification and a target center of gravity location of the container 370 (e.g., a center point of the interior space of the container 370 or a center area within the container 370). The closer (i.e., more aligned) the center of gravity of the custom packaging specification 16 is to the target center of gravity location, the greater the balance and stability of the custom packaging specification 16.

The aesthetics criteria can relate to the aesthetics of a custom packaging specification 16. For example, the aesthetics criteria can relate to a positioning or distribution of the one or more items i in the custom packaging specification 16. In an example implementation, a custom packaging specification 16 may be considered more aesthetically pleasing if a greater number of the one or more items i are immediately viewable when the protective structure 378 is opened. In another example implementation, a custom packaging specification 16 may be considered more aesthetically pleasing if preferred portions of the one or more items i (e.g., a portion including a graphic or label) are immediately viewable when the protective structure 378 is opened. In still another example implementation, a custom packaging specification 16 may be considered more aesthetically pleasing if the positioning of the one or more items i conveys a sense of symmetry, proportionality, and/or order to a recipient. According to additional and/or alternative examples, the aesthetic criteria can include an indication as to whether certain types of protective structures 378 and/or containers 370 are considered to be more aesthetically pleasing than other types of protective structures 378 based on, for example, a material, a shape, a size, a color, and/or a coating on the protective structure 378 and/or the container 370. For example, due to the level of customization that may be achieved by the system 100, uniquely shaped protective structures 378 may have artistic value.

According to some aspects of the present disclosure, the packaging optimization module 105 can be configured to first determine a plurality of alternative packaging specifications 16 based on the characteristic data 14 of the one or more items i and then select one of the alternative packaging specifications 16 based on the one or more enhancement criteria. The plurality of alternative packaging specifications 16 can be determined using one or more algorithms configured to design a custom packaging specification 16 based on part or all of the available characteristic data 14 for the one or more items i. As one non-limiting example, the one or more algorithms can include a nesting algorithm and/or a volumetric optimization algorithm, which can minimize airspace in the container 370, thereby reducing the volume of the assembled package and saving space on trucks.

Additionally, for example, the design algorithms can determine the alternative packaging specifications 16 based on a set of design constraints (e.g., minimum requirements, preferences, etc.). The design constraints can be determined based on the analysis of the characteristic data 14 and can relate to any aspect of the container 370, the arrangement 376, and/or the protective structure 378 described above (e.g., material, shape, size, dimensions, performance characteristics, protection characteristics, number of containers 370, number of protective structures 378, etc.). As one non-limiting example, a design constraint can indicate that the custom packaging specifications 16 should be capable of withstanding an impact of at least a threshold g-force without damage to the items i. As another non-limiting example, a design constraint can indicate that a package assembled according to a custom packaging specification 16 cannot exceed a maximum threshold weight or a maximum threshold size. Additionally, for example, the design constraint can be based on information indicated in the order 02. For example, the order 02 can indicate that a particular shipper, a particular size container, a particular type of packaging material, etc. be used.

In some example implementations, the number of alternative packaging specifications 16 that are designed and evaluated by the packing optimization module 105 can be based on an estimated time required to retrieve the items i by the automated picking system 130. For example, the packaging optimization module 105 can be communicatively coupled to the order processing module 103 and/or the inventory module 104 to receive information about the estimated to time for retrieving the items i. Accordingly, the packaging optimization module 105 can ensure that the custom packaging specification 16 is ready by the time the items i arrive for packing (or at least minimize delays).

According to some aspects, the custom packaging specification 16 that is utilized by the automated packaging manufacturing system 150 and the automated packing system 140 can be selected from the plurality of alternative packaging specifications 16 based on a single enhancement criterion. As one non-limiting example, the characteristic data 14 of the one or more items i can be processed to determine a custom packaging specification 16 that is configured to utilize the least amount of material for the protective structure 378 regardless of any other enhancement criteria. As another non-limiting example, the characteristic data 14 of the one or more items i can be processed to determine a custom packaging specification 16 that will cost the least amount to produce and ship to a destination indicated in the transaction details of an order 02.

According to other aspects of the present disclosure, the packaging optimization module 105 can be configured to determine a custom packaging specification 16 for the one or more items i based on a plurality of the enhancement criteria. In many implementations, there may not be one custom packaging specification 16 that can be considered the best for all of the enhancement criteria. Rather, it may be that there are tradeoffs associated with the enhancement criteria. For example, a custom packaging specification 16 that costs the least may not provide the most protection for the one or more items i. As another example, an arrangement 376 that is the most aesthetically pleasing may unevenly distribute the weight of the one or more items i such that the container 370 is difficult to handle.

To select one of the plurality of alternative packaging specifications 16 based on a plurality of enhancement criteria, the packaging optimization module 105 can be configured to employ one or more multiple-criteria decision analysis (MCDA) algorithms. Non-limiting examples of the one or more multiple-criteria decision analysis algorithms can include an aggregated indices randomization method (AIRM), an analytic hierarchy process (AHP), an analytic network process (ANP), a data envelopment analysis, a decision expert (DEX), a dominance-based rough set approach (DRSA), an elimination and choice expressing reality (ELECTRE) analysis, an evidential reasoning approach (ER), a goal programming application, a multi-attribute global inference of quality (MAGIQ) analysis, a multi-attribute utility theory (MAUT), a multi-attribute value theory (MAVT), a potentially all pairwise rankings of all possible alternatives (PAPRIKA) analysis, a technique for the order of prioritization by similarity to ideal solution (TOPSIS) analysis, a value analysis (VA), a weighted product model (WPM), a weighted sum model (WSM), combinations thereof, and/or the like.

Figure 4:
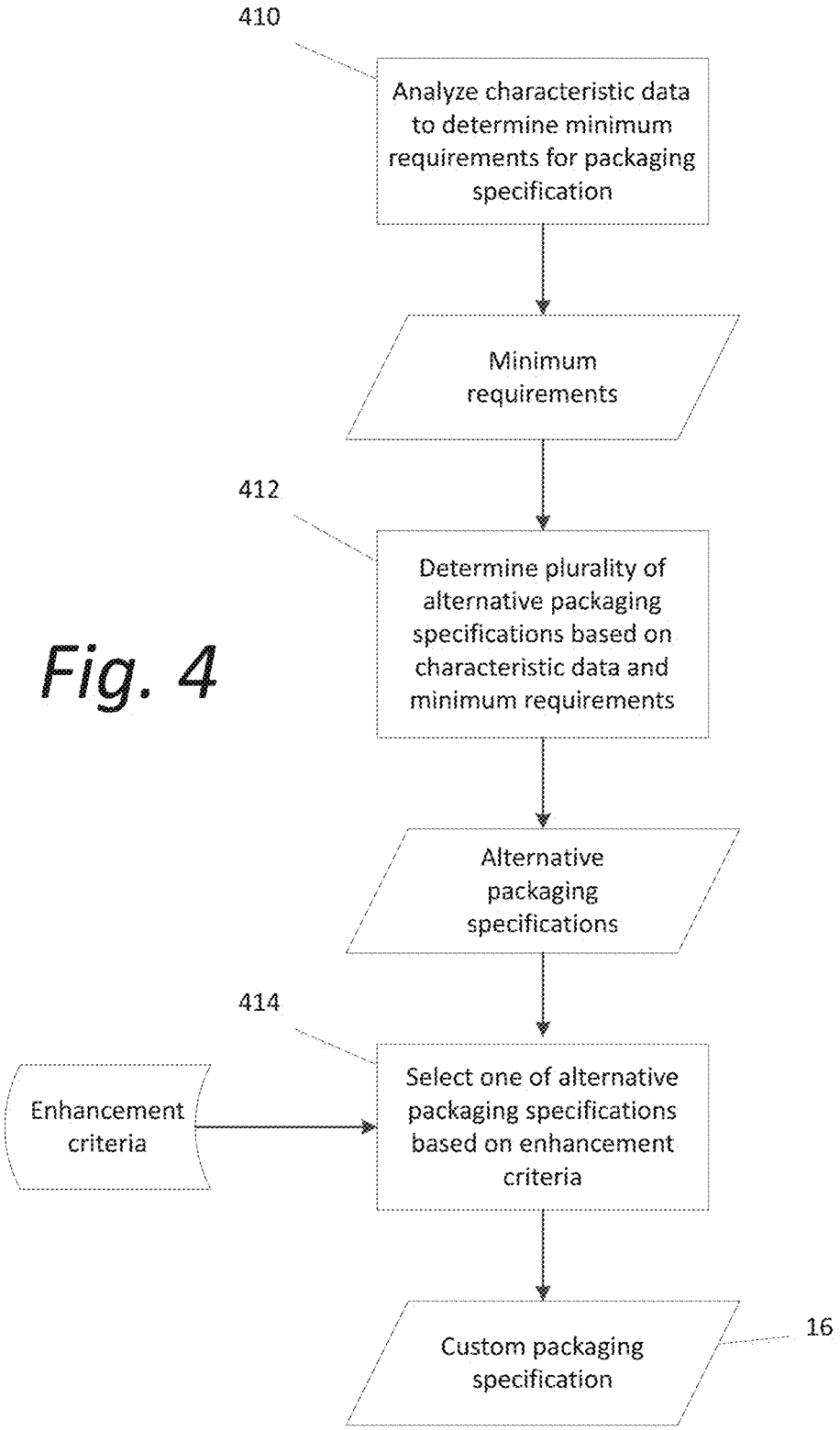
FIG. 4 illustrates a flowchart for an example approach for determining a packaging specification, according to aspects of the present disclosure.

Referring now to FIG. 4, an example subroutine for determining a custom packaging specification 16 based on one or more enhancement criteria is illustrated. At act 410, the characteristic data 14 for the one or more items i of an order 02 is analyzed to determine a set of design constraints for the custom packaging specification 16. At act 412, a plurality of alternative packaging specifications 16 are determined based on the characteristic data 14 and the design constraints. At act 414, one of the plurality of alternative packaging specifications 16 is selected based on one or more enhancement criteria. For example, a multiple-criteria analysis decision algorithm can be utilized to select the one packaging specification 16 from the plurality of alternative packaging specifications 16.

According to some aspects of the present disclosure, the packaging optimization module 105 can simulate how each alternative packaging specification 16 would perform under various test conditions to can evaluate the potential alternative packaging specifications 16. For example, the packaging optimization module 105 can employ physics-engine software for simulating drops from various heights, compressions under various loads, vibrations, thermal effects, etc. According to additional or alternative aspects of the present disclosure, the packaging optimization module 105 can utilize the spatial mapping of the data models for the items i, the protective structure, and the container 370 to run the simulations and identify where potential points of failure or weakness may be located. It is contemplated that, according to some aspects of the present disclosure, the packaging optimization module 105 can be configured to determine an initial set of alternative packaging specifications 16, analyze the initial set based on the simulations, and then modify one or more of the alternative packaging specifications 16 based on an outcome of the simulations. In some instances, the simulation, analysis, and modification process may be iteratively repeated until no further improvements are achieved.

It is further contemplated that, according to some embodiments, the order system 100 can include one or more user input/output devices (not shown) for facilitating user review and modifications to one or more of the alternative packaging specifications 16. For example, a display device can be configured to display information related to the packaging specifications 16 in the form of text, numbers, and/or graphics (e.g., information related to materials, shapes, sizes, dimensions, performance characteristics, protection characteristics, number of containers 370, number of protective structures 378, simulation data, spatial mapping graphics, etc.). Additionally, for example, a keyboard, a mouse, and/or a touch screen can be configured to allow a user to modify aspects of the packaging specification 16 to further customize the packaging specification 16.

FIG. 4, described by way of example above, represents one algorithm that corresponds to at least some instructions executed by one or more processor(s) to perform the above described functions associated with the described concepts. It is also within the scope and spirit of the present concepts to omit steps, include additional steps, and/or modify the order of steps presented above. Additionally, it is contemplated that one or more of the steps presented above can be performed simultaneously. For example, the plurality of alternative packaging specifications 16 can be determined first, the design constraints can be determined thereafter, and then the alternative packaging specifications 16 can be compared to the design constraints to eliminate from further consideration any packaging specifications 16 that do not meet the design constraints. As another example, the plurality of alternative packaging specifications 16 can be determined based on the characteristic data 14 and the one or more enhancement criteria first and then one or more multiple-criteria decision analysis algorithms can be utilized to select a custom packaging specification 16. Still further, it is contemplated that, according to alternative aspects of the present disclosure, a single packaging specification 16 can be determined based on a single algorithm with the characteristic data 14, one or more enhancement criteria, and optionally one or more design constraints as inputs. That is, the custom packaging specification 16 can be determined without determining a plurality of alternatives from which to choose.

According to some aspects of the present disclosure, the container parameters, the arrangement parameters, and the protection parameters can be interdependently determined together. According to some alternative aspects of the present disclosure, one or more of the container parameters, the arrangement parameters, and the protection parameters can be determined independently of the others. As one non-limiting example, to minimize the overall size of an assembled package, the arrangement 376 can be determined first, then the protective structure 378 can be determined based on the arrangement 376, and then the container 370 can be determined based on the protective structure 378.

Figure 3C:
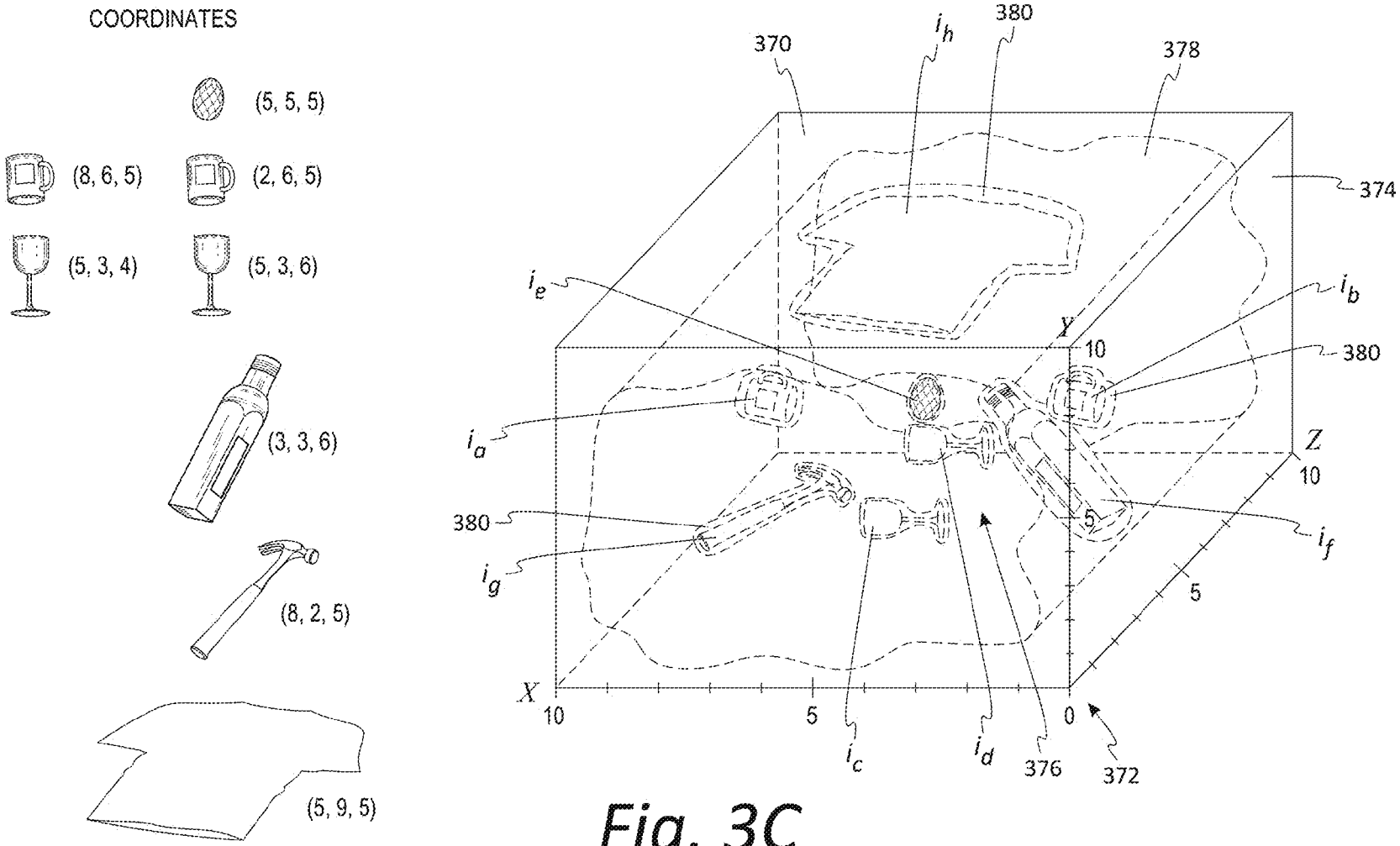
FIG. 3C illustrates the container, arrangement, and protective structure of FIGS. 3A-3B assembled according to an example packaging specification.

To illustrate some example features of a custom packaging specification 16 that may be determined based on the characteristic data 14 and the enhancement criteria, FIG. 3C illustrates an example packaging specification 16 for the examples of FIGS. 3A-3B. In the illustrated example, the n items i include a first coffee mug $i_a$, a second coffee mug $i_b$, a first glass $i_c$, a second glass $i_d$, a porcelain egg $i_e$, an olive oil bottle $i_f$, a hammer $i_g$, and a t-shirt $i_h$. The characteristic data 14 associated with the items i can indicate, amongst other things, that the coffee mugs $i_a$, $i_b$ include a graphic on a portion of an exterior surface, a stem and a rim of the glasses are particularly fragile, the porcelain egg $i_e$ is a particularly valuable item i, the olive oil bottle $i_f$ and the hammer $i_g$ are heavier items i, and the t-shirt $i_h$ is not fragile.

In the example packaging specification 16 of FIG. 3C, the arrangement 376 of the packaging specification 16 has been optimized (e.g., based on the protection criteria) to provide additional protection to the valuable porcelain egg $i_e$ and the fragile glasses $i_c$, $i_d$ by positioning those items i in a central area within the protective structure 378 and the container 370. The more centrally located the items i, the more protected the items i are likely to be. Additionally, the arrangement 376 has been optimized (e.g., based on the package handling criteria) to evenly distribute the weight of the items i within the interior space 374 of the container 370 to improve package handling. For example, as indicated by the coordinates associated with the items i, the porcelain egg $i_e$ is positioned at a center point (i.e., a coordinate (5, 5, 5)) of the container 370, the t-shirt $i_h$ is positioned above the center point, the coffee mugs $i_a$, $i_b$ are positioned equidistantly from the center point, the glasses $i_c$, $i_d$ are positioned equidistantly from the center point, the glasses $i_c$, $i_d$ are offset perpendicularly relative to the coffee mugs $i_a$, $i_b$, and the olive oil bottle $i_f$ and the hammer $i_g$ are spaced from the center point to balance each other out. In particular, because the olive oil bottle $i_f$ is heavier than the hammer $i_g$, the olive oil bottle $i_f$ is positioned slightly closer to the center point than the hammer $i_g$. In the example illustrated in FIG. 3C, the arrangement 376 is also configured (e.g., based on the aesthetic criteria) such that the coffee mugs $i_a$, $i_b$ and the porcelain egg $i_e$ are immediately viewable when the protective structure 378 is opened. Additionally, the coffee mugs $i_a$, $i_b$ positioned in the arrangement 376 are oriented such that the graphic image on the coffee mugs $i_a$, $i_b$ is viewable when the protective structure 378 is opened.

In the example packaging specification 16 of FIG. 3C, the protective structure 378 of the packaging specification 16 has been optimized (e.g., based on protection criteria) to have a greater amount of material adjacent to the porcelain egg $i_e$ due to its value as compared to the other items i, which are not considered to be as valuable. Additionally, the protective structure 378 has been optimized to have a different type of material adjacent to the rim and the stem of the glasses $i_c$, $i_d$ as compared to the rest of the glasses $i_c$, $i_d$ due to the fragility of the rim and the stem. In particular, the material adjacent to the stem and the rim of the glass $i_c$, $i_d$ can be configured to be compliant while the material adjacent to the rest of the glass $i_c$, $i_d$ is rigid. In this way, the protective structure 378 can minimize the risk of damage to the stem and the rim of the glasses $i_c$, $i_d$ with the compliant material while firmly holding the glasses $i_c$, $i_d$ in place with the rigid material. Still further, the protective structure 378 has been optimized (e.g., based on the packaging efficiency criteria) to have a minimal amount of material adjacent to the t-shirt $i_h$ because the t-shirt $i_h$ is not considered to be fragile and may itself act as a cushioning material to assist in protecting the items i beneath it.

In the example packaging specification 16 of FIG. 4, the container 370 of the packaging specification 16 has been optimized to have a sufficient volume to accommodate the arrangement 376 of items i and the protective structure 378 while closely fitting to the size of the protective structure 378. Additionally, the container 370 is made from a cardboard material having a flute size determined to provide performance characteristics that combine with the protection characteristics of the protective structure 378 to meet or exceed design constraints (e.g., minimum requirements) for protecting the items i.

Other potential features of a custom packaging specification 16 that can be determined based on the enhancement criteria include, for example, providing additional material for the protective structure 378 in select areas to improve the protection characteristics of the protective structure 378 for a fragile item i or a valuable item i. Additionally, for example, the custom packaging specification 16 can be configured to include less material for the protective structure 378 or an aperture in the protective structure 378 adjacent to items i that are less fragile or valuable. As yet another example, the custom packaging specification 16 can be configured to include a plurality of containers 370 to reduce shipping costs due to the weight and the size of the assembled containers 370. As still another example, the custom packaging specification 16 can be configured to separate items I into different containers 370 based on regulatory requirements mandating that certain items i be shipped individually or under particular circumstances that may not be necessary or desirable for other items i. As yet another example, the custom packaging specification 16 can be configured to have varying densities of materials for the protective structure 378 to vary the protection characteristics for different items i (e.g., areas with denser material may provide more protection than less areas with less dense material). In another example, the custom packaging specification 16 can be configured such that a center of gravity of the protective structure 378 is designed to counter an imbalance due to a center of gravity of the arrangement 376 of items i and vice versa. In a further example, the custom packaging specification 16 can be configured to nest a plurality of items i to reduce the amount of material, the volume of the container 370, the empty air space in the container 370, and the costs. In yet another example, the custom packaging specification 16 can be configured to minimize the number of separate pieces that comprise the protective structure 378. In still another example, the custom packaging specification 16 can be optimized to reduce an associated environmental impact due to, for example, an amount of energy required to manufacture the protective structure 378 and/or pack the items i, an amount of waste associated with the manufacture of the protective structure 378, and/or the types of materials utilized in the packaging specification 16. In another example, the packaging specification 16 can be optimized to make it easy for a recipient to unpack the items i from the container 370. It should be understood that the features for a custom packaging specification 16 described and illustrated for FIG. 3C are but a few examples and many other features for the packaging specification 16 are contemplated by the present disclosure.

After the custom packaging specification 16 is determined at act 216, the protection parameters are communicated from the packaging optimization module 105 to the packaging manufacture controller 107. At act 218, the protective structure 378 is manufactured by the automated packaging manufacturing system 150, controlled by the packaging manufacture controller 107, according to the protective parameters of the custom packaging specification 16. The automated packaging manufacturing system 150 is configured to rapidly manufacture the protective structure 378. Rapid manufacturing allows the protective structure 378 to be completed or substantially completed during the time generally required to complete the picking process described further below.

According to some aspects, the protective structure 378 can be formed using an additive manufacturing process. For example, the protective structure 378 can be formed by a 3D printing process, which forms the protective structure 378 by laying down a plurality of successive layers of material. According to some additional or alternative aspects, the protective structure 378 can be formed using a subtractive manufacturing process. For example, a cutting process, a milling process, a drilling process, and/or an ablation process can be employed to remove controlled amounts from a raw material to form the protective structure 378. According to further additional or alternative aspects, the protective structure 378 can be formed by a stamping process, a casting process, a molding process, a forming process, a machining process, and/or a joining process. In general, however, the protective structure 378 can be formed by reshaping a packaging material. Depending on the manufacturing process or the materials employed, the forming of the protective structure 378 can also include a curing process.

According to some aspects of the present disclosure, the protective structure 378 can be manufactured based on the coordinate information and/or voxel-based data for the protective structure 378 indicated by the protection parameters. For example, the automated packaging manufacturing system 150 also can employ a coordinate system 372 that provides a frame of reference for a work space upon which the protective structure 378 is manufactured such that the coordinate information and/or voxel-based data of the protective structure 378 can be mapped to the coordinate system 372 of the automated packaging manufacturing system 150.

IV. Picking Process

Figure 5:
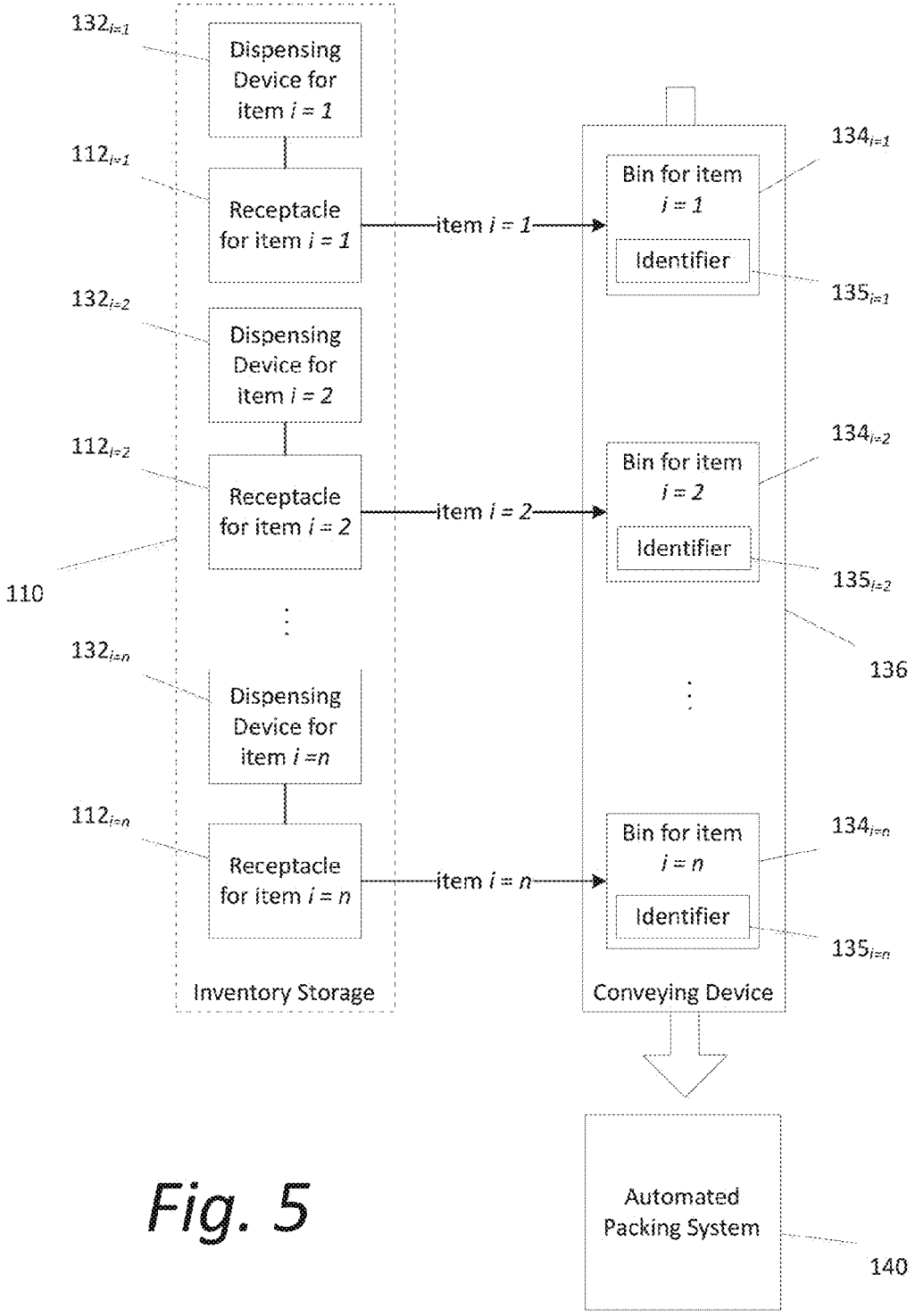
FIG. 5 illustrates an example system for picking items in an order, according to aspects of the present disclosure.

As described above, the automated picking system 130 shown in FIG. 1 retrieves items i for the order 02 from the inventory storage 110. Referring to FIG. 5, an example implementation of the automated picking system 130 is illustrated.

As shown in FIG. 5, the inventory storage 110 includes receptacles 112 for storing respective inventories of the n items i specified in the order 02. In particular, a receptacle $112_{i=1}$ stores an inventory of the item i=1, a receptacle $112_{i=2}$ stores an inventory of the item i=2, . . . , and a receptacle $112_{i=n}$ stores an inventory of the item i=n. Of course, although not shown, it is understood that the inventory storage 110 may include inventories of items that are not specified in the order 02 but that may be specified in other orders. Information about the inventories of items in the inventory storage 110 may be maintained in the item database 06. In addition, the inventory module 104 of the computing system 101 may process information relating to the inventories of items in the inventory storage 110.

When the order 02 is received by the order system 100, the picking/packing controller 106 of the computing system 101 causes the automated picking system 130 to retrieve the desired quantities of items i=1, 2, . . . , n from their respective receptacles 112*i*. In the example of FIG. 5, it is assumed that the inventory storage 110 stores the desired quantities of items i=1, 2, . . . , n specified in the order 02. As described above, however, the shipment of an order 02 may be dynamically modified if the inventory module 104 determines that there is insufficient inventory to fulfill a request for one or more of the items i=1, 2, . . . , n specified in the order 02. In general, the automated picking system 130 can retrieve available items for partial order shipment, and subsequent partial order shipments can be additionally made as the other items become available.

The automated picking system 130 provides a dispensing device 132*i* for each receptacle 112*i*. Each dispensing device 132*i* moves the desired quantity of item i from the receptacle 112*i* to a respective bin 134*i*. The bins 134 move on a conveying device 136 that passes near the receptacles 112. For each item i, the automated picking system 130 operates the conveying device 136 to position the bin 134*i* near the receptacle 112*i* and then operates the dispensing device 132*i* to move the specified quantity of item i into the bin 134*i* on the conveying device 136.

Each dispensing device 132*i* may be individually controlled by the automated picking system 130. For example, each dispensing device 132*i* may include an electromechanically and/or hydraulically actuated mechanism that pushes the desired quantity of item i into the bin 134*i* from the receptacle 112*i*. The items i may be arranged in the receptacle 112*i* to allow the mechanism to push one item i at a time from the receptacle 112*i*. Furthermore, a surface, e.g., an inclined surface defined by a series of rollers, may lead from the receptacle 112*i* to the bin 134*i* to facilitate the transfer of the item i.

The automatic picking system 130 assigns each bin 134*i* to the respective items i, i.e., bin 134*i*=1 is assigned to item i=1, bin 134*i*=2 is assigned to item i=2, . . . , bin 134*i*=n is assigned to item i=n. Knowing these bin assignments, the automatic picking system 130 can determine where the retrieved items i=1, 2, . . . , n are by tracking the locations of bin 134*i*=1, bin 134*i*=2, . . . , bin 134*i*=n, respectively. Accordingly, each bin 134*i* includes an identifier 135*i* that allows the automated picking system 130 to track the location of the bini. For example, the identifier 135*i* may include a barcode and/or other marking that can be read by image capture and/or scanning devices at various locations. Additionally or alternatively, the identifier 135*i* may include a radio-frequency identification (RFID) or other signal-emitting device that can be used to track the bin 134*i* wirelessly.

After the items i=1, 2, . . . , n have been transferred from the receptacles 112*i* to the bins 134*i*, respectively, the automated picking system 130 operates the conveying system 136 to move the bins 134 to a designated location for packing by the automated packing system 140. During the picking process, the automated picking system 130 may also retrieve items for other orders. The bins 134 for the order 02 may then become interspersed with bins for other orders. As such, the automated picking system 130 tracks the location of the bins 134 with the items i=1, 2, . . . , n so that they are conveyed on the conveying device 136 in the proper direction and deliver the items i=1, 2, . . . , n to the appropriate location for packing.

This picking process occurs in parallel with the process of determining and manufacturing the protective structure(s) 378 described above. Rapid manufacturing allows the protective structure(s) 378 to be completed or substantially completed during the time generally required to complete the picking process. As such, the protective structure(s) 378 are available (with no delay or with minimal delay) when the items i=1, 2, . . . , n are ready for packing. The proper protective structure(s) 378 are also conveyed to the appropriate location to be assembled with the retrieved items i=1, 2, . . . , n for packing.

Although FIG. 5 illustrates a single linear configuration of receptacles 112 and a single linear path for the conveying device 136 for clarity, it is understood that any number of conveying devices 136 may extend in varying directions and paths to move the bins 134 to and from varying arrangements of receptacles 112 at different locations in the inventory storage 110. Furthermore, although the conveying device 136 shown in FIG. 5 includes a conveyor belt that moves the bins 134, it is understood that other devices and approaches may be employed to move the items i to a packing location. For example, the automated picking system 130 may include one or more computer-controlled/tracked carts that move to the receptacles 112 to retrieve the items i and then move to a packing location to deliver the items i.

Although each receptacle 112 shown in FIG. 5 has its own dispensing device 132, it is understood that more than one receptacle 112 may share a common dispensing device, i.e., any configuration of dispensing devices 132 may be employed for any number of receptacles 112. Moreover, different types of dispensing devices 132 are contemplated by the present disclosure. For instance, in alternative embodiments, a robotic device may be employed to remove an item i from a receptacle 112*i* and to lift the item i a bin $\mathbf{134}_i$. (An example of a robotic device is described further below with reference to FIG. 6).

V. Packing Process

Figure 6:
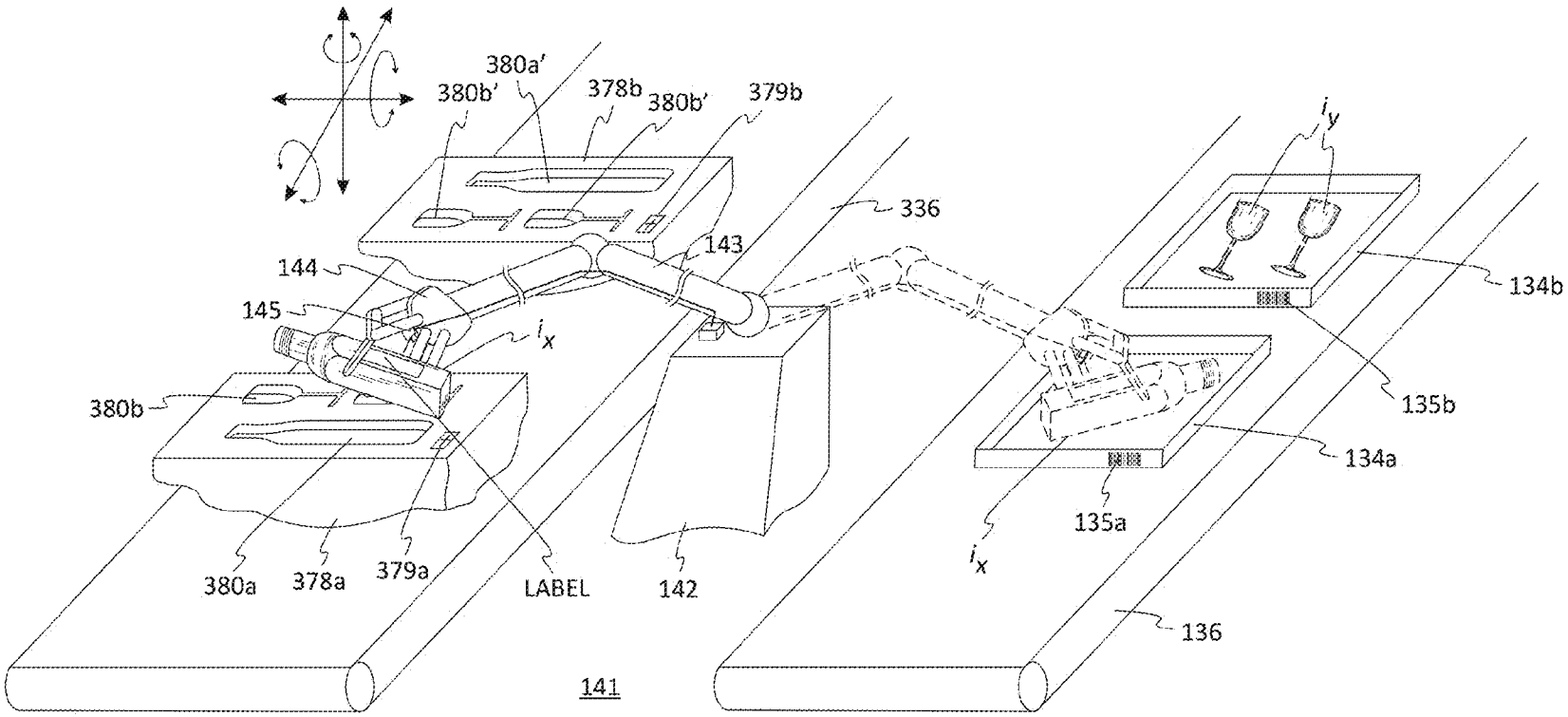
FIG. 6 illustrates an example system for packing items in an order, according to aspects of the present disclosure.

As described above, when the items i=1, 2, . . . , n have been retrieved and delivered to a designated packing location, the picking/packing controller 106 causes the automated packing system 140 to pack the items i in one or more containers 370. In particular, the automated packing system 140 packs the items i with one or more custom protective structures 378 according to the custom packaging specification 16. Referring to FIG. 6, an example implementation of the automated packing system 140 is illustrated.

As shown in FIG. 6, the automated picking system 130 delivers bins 134*a* and 134*b* to a packing location 141 via the conveying device 136. The bin 134*a* includes a quantity of an item $i_x$ (an olive oil bottle), and the bin 134*b* includes a quantity of an item $i_y$ (two glasses), where the items $i_x$ and $i_y$ correspond to items specified in an order 02.

As described above, the bins 134*a* and 134*b* include identifiers 135*a* and 135*b* that allow the automated picking system 130 to track the location of the bins 134*a* and 134*b* and the items $i_x$ and $i_y$, respectively. The identifiers 135*a* and 135*b* may include a barcode and/or other marking that can be read by image capture and/or scanning devices at various locations. Additionally or alternatively, the identifiers 135*a* and 135*b* may include a radio-frequency identification (RFID) or other signal-emitting device that can be tracked wirelessly. When the bins 134*a* and 134*b* arrive at the packing location 141, the identifiers 135*a* and 135*b* also allow the automatic packing system 140 to confirm that the items $i_x$ and $i_y$ specified in the order 02 have been delivered to the packing location 141.

As shown in FIG. 6, the automatic packing system 140 may include a robotic device 142 that handles the packing of items $i_x$ and $i_y$ for the order 02. The robotic device 142 includes an arm 143 that extends outwardly. A grasping device 144 is disposed at the distal end of the arm 143 to handle the items i. An image capture/scanning device 145 (e.g., camera) is also disposed at the distal end of the arm 143. According to one aspect, the image capture/scanning device 145 can evaluate the identifier 135 on each bin 134 by reading a barcode and/or other marking. Additionally or alternatively, the automatic packing system 140 can use information from an RFID or other signal-emitting device to determine what bins 134 are located in the packing location 141. The data from the image capture/scanning device 145 may be communicated to the picking/packing controller 106 for processing.

Another conveying device 336 (e.g., a conveyor belt) delivers the protective structures 378*a* and 378*b* from the automated packaging manufacturing system 150 to the packing location 141. The automated packing system 140 packs the items $i_x$ and $i_y$ for shipment with the protective structures 378*a* and 378*b*. The protective structures 378*a* and 378*b* are manufactured to provide a more optimal packaging scheme as set forth by the custom packaging specification 16. In particular, the automated packaging system 150 manufactures the first protective structure 378*a* to define recesses 380*a* and 380*b*. Correspondingly, the automated packaging system 150 manufactures the second protective structure 378*b* to define recesses 380*a*' and 380*b*'. When the protective structures 378*a* and 378*b* are combined, the recesses 380*a* and 380*a*' define an internal cavity that receives the item $i_x$, and the recesses 380*b* and 380*b*' define two internal cavities that respectively receive the items $i_y$. With the items $i_x$ and $i_y$ in these internal cavities, the $i_x$ and $i_y$ are protected during shipment. The protective structures 378*a* and 378*b* are formed from one or more materials to absorb forces that may damage the items $i_x$ and $i_y$ during shipment. Additionally, the internal cavities determine how the items $i_x$ and $i_y$ are positioned relative to each other and within a container (as described above) to provide enhanced protection during shipment.

To confirm that the protective structures 378*a* and 378*b* have been delivered to the packing location 141, the automatic packing system 140 can evaluate identifiers 379*a* and 379*b* provided on the protective structures 378*a* and 378*b*, respectively. Similar to the identifiers 135 on the bins 134, the identifiers 379*a* and 379*b* may include a barcode and/or other marking. In such a case, the image capture/scanning device 145 on the robotic device 142 may be employed to read the barcode and/or marking to identify the protective structures 378*a* and 378*b*. Additionally or alternatively, the identifiers 379*a* and 379*b* may include a radio-frequency identification (RFID) or other signal-emitting device that can be used to identify the protective structures 378*a* and 378*b* wirelessly.

When the automated packing system 140 determines that the desired items $i_x$ and $i_y$ and the corresponding protective structures 378*a* and 378*b* have been properly delivered to the packing location 141, the automated packing system 140 transfers the items $i_x$ and $i_y$ from the bins 134*a* and 134*b* to the recesses 380*a* and 380*b* of the protective structure 370*a*, respectively. As shown in FIG. 6, the grasping device 144 of the robotic device 142 can be employed to transfer the items $i_x$ and $i_y$. The automated packing system 140 refers to the custom packaging specification 16 to determine the how the items $i_x$ and $i_y$ should be positioned in the recesses 380*a* and 380*b*. In particular, the packaging optimization module 105 communicates the custom packaging specification 16 to the picking/packing controller 106 which in turn signals the automated packing system 140 how to pack the items $i_x$ and $i_y$.

The robotic device 142 can employ the image capture/scanning device 145 to capture one or more images of the bins 134*a* and 134*b*. The captured images are communicated to the picking/packing controller 106, which can then process the images to identify the bins 134*a* and 134*b* as well as the shape, position, and orientation of each item in the bins 134*a* and 134*b*. For example, the picking/packing controller 106 can employ object segmentation techniques to identify various shapes in the images and compare the shapes to stored information (e.g., stored images) describing the bins 134*a* and 134*b* as well as the items $i_x$ and $i_y$. Information on the shape of the items $i_x$ and $i_y$ may be stored in the item database 06. Accordingly, based on the images captured by the device 145, the robotic device 142 can properly orient itself relative to the bins 134*a* and 134*b* to grasp the items $i_x$ and $i_y$, respectively. Furthermore, using the captured images, the robotic device 142 can properly orient the grasping device 144 to handle and grasp the items $i_x$ and $i_y$ appropriately.

As shown in FIG. 6, the robotic device 142 can move the grasping device 144 according to six degrees of freedom. Therefore, the robotic device 142 can manipulate each item $i_x$ and $i_y$ so that they are handled with necessary care and properly positioned and oriented in the recesses 380*a* and 380*b* defined by the protective structures 378*a* and 378*b*. As FIG. 6 illustrates, the grasping device 142 first transfers the item $i_x$ (the olive oil bottle). Using the captured image(s) of the bin 134*a*, the grasping device 144 can be controlled to handle the olive oil bottle more stably at the body rather than, for example, the neck. In addition, the captured images can be employed to identify the label on the olive oil bottle, and the grasping device 144 can be controlled to turn the olive oil bottle so that the label will be properly oriented when it is eventually positioned in the recess 380*a*. Once the grasping device 144 grasps the item $i_x$ at the bin 134*a*, the robotic device 142 carries the item $i_x$ to the protective structures 378*a* and 378*b*.

Using the custom packaging specification 16, the automatic packing system 140 can determine that the first protective structure 378*a* is configured to protect the items $i_x$ and $i_y$ from the bottom and the second protective structure 378*b* is configured to protect the items $i_x$ and $i_y$ from the top. As such, the robotic device 142 first positions the items $i_x$ and $i_y$ in the first protective structure 378*a* and then subsequently places the second protective structure 378*b* over the items $i_x$ and $i_y$.

The robotic device 142 can also employ the image capture/scanning device 145 to capture one or more images of the first protective structure 378*a*. Based on the information in the captured images, the robotic device 142 can orient itself relative to the first protective structure 378*a*. In addition, using the captured images, the robotic device 142 can properly orient the grasping device 144 to position the items $i_x$ and $i_y$ properly relative to the recesses 380*a* and 380*b*, respectively. For example, the captured images are communicated to the picking/packing controller 106, which can then process the images to identify the first protective device 378*a* as well as the shape, position, and orientation of each recess 380*a* and 380*b*. In some cases, the picking/packing controller 106 can employ object segmentation techniques to identify the shapes in the images based on the design of the first protective device 378*a* provided by the custom packaging specification 16.

Additionally or alternatively, markings may be provided directly on the protective devices 378*a* that can be identified in images captured by the image capture/scanning device 145. These markings allow the picking/packing controller 106 to determine the orientation of the first protective device 378*a* and identify the recesses 380*a* and 380*b*. For instance, as shown in FIG. 6, the identifier 379*a* includes cross hairs that indicate how the first protective device 378*a* is positioned and oriented relative to the robotic device 142. In addition, respective markings may be placed in or near each recess 380*a* and 380*b* to indicate what items should be placed in each recess 380*a* and 380*b*.

Knowing where the recess 380*a* is positioned and oriented relative to the robotic device 142, the grasping device 144 can be controlled to manipulate the olive oil bottle according to one or more six degrees of freedom to position and orient the olive oil bottle relative to the recess 380*a* and to place the olive oil bottle in the recess 380*a*. As illustrated in FIG. 6, the bottle has been manipulated to ensure that when the olive oil bottle is placed in the recess 380*a*, the label faces upwardly from the recess 380*a*. Thus, when the packaging is opened by the recipient, the label is displayed to the recipient from the recess 380*a* in an aesthetically pleasing way. If necessary, the grasping device 144 can be further controlled to turn the olive oil bottle after the olive oil bottle has been placed in the recess 380*a* and ensure that the label is properly displayed.

After the olive oil bottle is transferred to the recess 380*a*, the robotic device 142 moves the grasping device 144 to the bin 134*b* to transfer the items $i_y$ (the glasses) to the recesses 380*b* in the protective structure 378*a*. Using captured image(s) of the bin 134*b*, the position and orientation of each glass can be determined. As such, the grasping device 144 can be controlled to handle each glass more stably at the bowl rather than, for example, the stem or foot. Once the grasping device 144 grasps the first of the glasses at the bin 134*b*, the robotic device 142 carries the first glass to the protective structure 378*a*. Using captured image(s) of the first protective device 378*a*, the position and orientation of each recess 380*b* can be determined. Knowing where the recess 380*b* is positioned and oriented relative to the robotic device 142, the grasping device 144 can be controlled to manipulate the first glass according to one or more six degrees of freedom to position and orient the glass relative to one of the recesses 380*b* and to place the glass in the first recess 380*b*. After the first glass is transferred to the first recess 380*b*, the robotic device 142 similarly transfers the second of the glasses to the second of the recesses 380*b* in the protective structure 378*a*.

Once the items $i_x$ and $i_y$ have been transferred to the first protective structure 380*a*, the robotic device 142 can place the second protective structure 378*b* over the first protective 378*a*. Using captured image(s) of the second protective device 378*b*, the recesses 380*a*' and 380*b*' can be identified and their position and orientation relative to the robotic device 142 can be determined. The picking/packing controller 106 can process these captured images in a manner similar to the images captured for the first protective structure 378*a*. Knowing where the recesses 380*a* and 380*b* of the first protective structure 378*b* are also positioned and oriented relative robotic device, the grasping device 144 can manipulate the second protective structure 378*b* so that the recesses 380*a*' and 380*b*' of the second protective structure 378*b* face downwardly and align with the recesses 380*a* and 380*b* of the first protective device 378*a*. As such, the recesses 380*a*' and 380*b*' can be placed over the items $i_x$ and $i_y$ disposed in the recesses 380*a* and 380*b*, respectively. When the first protective structure 378*a* and the second protective structure 378*b* are combined in this way, the recesses 380*a* and 380*a*' together define an internal cavity for the item $i_x$ and the recesses 380*b* and 380*b*' together define internal cavities for the items $i_y$. If required, the protective structures 378*a* and 378*b* can be secured together according to any appropriate technique, including, but not limited to, the use of tape, adhesive, string, mechanical/frictional engagement, shrink/stretch wrap, etc. In some embodiments, structural features of the protective structures 378*a* and 378*b* allow the robotic device 142 to grasp or otherwise manipulate the protective structures 378*a* and 378*b* more easily.

As illustrated in FIG. 6, the robotic device 142 can place the items $i_x$ and $i_y$ in the respective recesses 380*a* and 380*b* of the first protective structure 378*a* as a first step. The robotic device 143 can place the second protective structure 378*b* over the first protective structure 378*a* as a second step. Then, the robotic device 142 can place the combined protective structures 378*a* and 378*b* into a container 370, e.g., box, crate, etc., which has also been delivered to the packing location 141.

Figure 7:
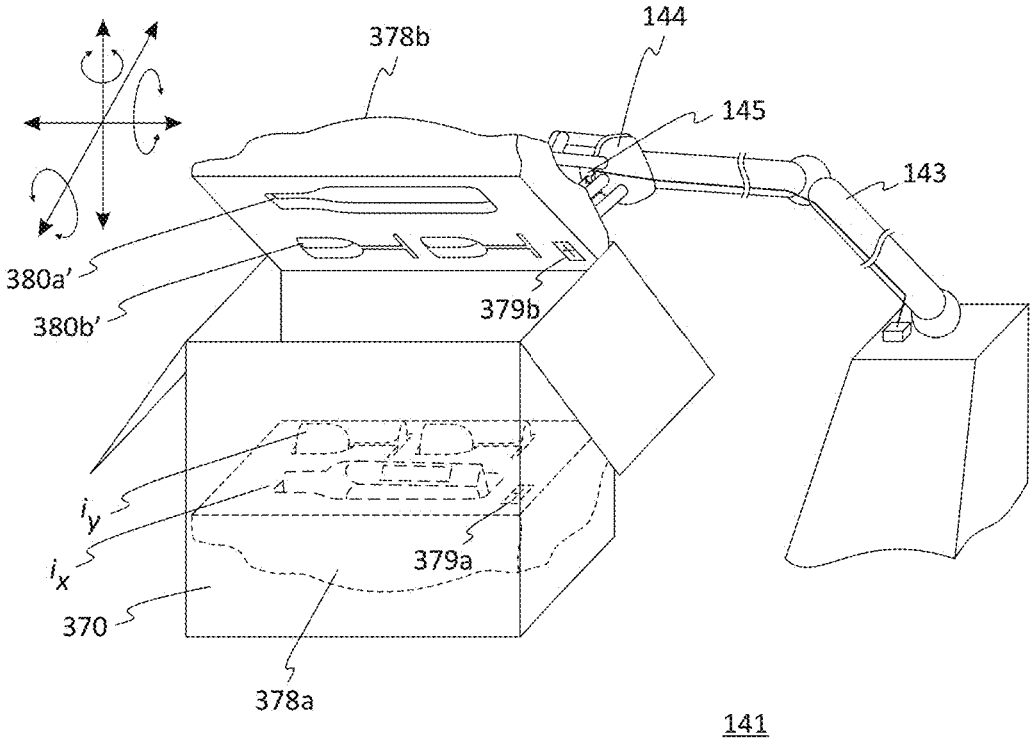
FIG. 7 illustrates further an example system for packing items in an order, according to aspects of the present disclosure.

Alternatively, as shown in FIG. 7, the robotic device 142 can place the first protective structure 378*a* with the items $i_x$ and $i_y$ in the container 370, before placing the second protective structure 378*b* over the first protective structure 378*a*. Or as a further alternative, the robotic device 142 can place the first protective structure 378*a* into the container 370, before placing the items $i_x$ and $i_y$ in the respective recesses 380*a* and 380*b*. The relative layered arrangement of the protective structure 378*a* and 378*b* allows the first protective structure 378*a*, the second protective structure 378*b*, and the items $i_x$ and $i_y$ to be easily placed into the container 370 in any one of many different sequences. In general, items i can be combined with the protective structures 378 and a container 370 in any order of steps.

Accordingly, the automated packing system 140 according to the present disclosure can use information from captured images to determine shape, position, and/or orientation of aspects of the bins 134, the items i, and the protective structures 378. Using shape, position, and/or orientation information, the automated packing system 140 can manipulate the items i according to one or more degrees of freedom to place them into recesses 380 of the protective structures 378 according to the custom packaging specification 16. As a result, the automated packing system 140 can position the items i relative to each other and the container 370 to achieve a more optimal arrangement in the three-dimensional space of the container 370.

VI. Example Protective Structure

As described above, the automated packaging manufacturing system 150 can produce one or more custom protective structures for positioning and protecting order items in a container according to a custom packaging specification. For example, as illustrated in FIGS. 1 and 2, the packaging optimization module 105 determines the custom packaging specification 16 after the order 02 is received, so that the custom packaging specification 16 can provide a packaging arrangement based on the actual combination 14 of items i in the order 02. Correspondingly, the automated packaging manufacturing system 150 produces one or more custom protective structures 378 after the order 02 is received and when the custom packaging specification 16 is ready. To provide prompt shipment of the order 02, manufacturing of the one or more custom protective structures 378 is preferably completed by the time that the items i have been assembled and are ready for packing. In other words, rapid manufacturing of the one or more protective structures 378 occurs while the items i are simultaneously retrieved from the inventory storage 110 and assembled at a packing location 141.

To achieve the rapid manufacturing of custom protective structures, the automated packaging manufacturing system 150 can manufacture a protective structure from a plurality of modular elements. The modular elements are readily and rapidly assembled to form a shape that allows items to be packaged according to a custom packaging specification determined from an analysis of the items. Each modular element acts as a single building block for the protective structure. The automated packaging manufacturing system 150 can manipulate each modular element, e.g., via machine/robotic device, to build a custom shape for the protective structure. Advantageously, because each modular element can be separately manipulated, the amount of material used to form each protective structure can be closely controlled to reduce waste of the material, shipment weight, costs, etc.

The modular elements can adhere to each other to form shapes that can support packaged items during shipment, while also absorbing any shocks, impacts, vibrations, or other external forces that may damage the packaged items. In other words, the adhesion between the modular elements is strong enough, so that the resulting protective structure can maintain the custom shape set forth by the custom packaging specification.

The modular elements may be formed from any material that can support and protect the packaged items. In some cases where the packaged items require more cushioning, the modular elements may be formed from foam rubber, fabricated cellular foam, polyurethane foam, polyethylene foam, polystyrene, elastomeric materials (e.g., gels), etc. Advantageously, the modular elements may be formed from biodegradable materials or agricultural byproducts (e.g., biofibers, mushrooms, or those produced with cornstarch), which are environmentally friendly and may be recycled, composted, or dissolved in water for disposal. Alternative cushioning materials may also include employ a soft outer material filled with air or other gas/fluid. In other cases where the items require less cushioning, the modular elements may be formed from harder plastics or materials.

Preferably, the modular elements are self-adhering, so that they readily adhere to each other when they come into contact. In some cases, an adhesive material is applied to the outer surface of the modular elements to make them self-adhering. For example, a liquid may be applied to the modular elements as they are delivered to the assembly, and the liquid dries/solidifies in time to make the modular elements self-adhering as they come into contact with other modular elements. In addition to applying the adhesive to make modular elements self-adhering prior to contact with other modular elements, adhesives can be additionally/optionally applied after contact to make the adhesion between modular elements stronger.

Strong fast-acting adhesives, such as cyanoacrylate adhesives, can be applied to the modular elements as they are placed into contact with each other. The type of adhesive material may depend on the material from which the modular elements are formed. For instance, a neoprene rubber adhesive (also known as a contact cement/adhesive) may be employed to adhere modular elements that are formed from a nonporous material, such as a plastic or rubber. Or for instance, a synthetic elastomer adhesive (e.g., a spray adhesive) may be employed to adhere modular elements that are formed from a foam.

In some cases, the modular elements can be coated with an adhesive material that provides adhesive properties when it is subsequently treated. For example, a water-activated adhesive may be applied to the outer surface of the modular elements before they are placed into contact with each other. Once the modular elements are positioned to form the protective structure, the modular elements are treated with water so that the adhesive properties of the coating are activated, causing the modular elements to adhere to each other. Water-activated adhesives may be formed from natural polymers from vegetable sources (e.g. dextrins, starches), protein sources (e.g. casein, blood, fish, soybean, milk albumen), animal (e.g. hides, bones), etc. Other water-activated adhesives may be formed from soluble synthetic polymers from polyvinyl alcohol, cellulose ethers, methylcellulose, carboxymethylcellulose, polyvinylpyrrolidone, etc. In other examples, the outer surface of the modular elements can be coated with a heat-activated adhesive or a solvent-activated adhesive and then treated with heat or solvents, respectively, so that the adhesive properties of the coating are activated, causing the modular elements to adhere to each other.

The modular elements can be coated with the unactivated adhesive material and dried before they are positioned to define the protective structure. Advantageously, these modular elements are easier to manipulate during positioning because they are dry and non-adhesive. Once the modular elements are positioned, the adhesive properties can be activated by the subsequent treatment (e.g., application of water, heat, or solvents).

Alternatively, the modular elements may be formed from a material that has inherent adhesive qualities and that readily bonds to itself. For example, the material may be a polymer material with a tackifier which imparts a tackiness or stickiness to the surface of the material (e.g., a material including polymerizing styrene and hydrogenated polyterpene resin as a tackifier). Or for another example, the self-adhering material may employ static electrical forces to cause the material to adhere. By employing a material with inherent adhesive qualities, the application of an additional adhesive material may be unnecessary.

Preferably, the modular elements are quickly combined, e.g., via adhesive(s) and/or inherent adhesive properties, so that the protective structures can be ready by the time the items are in place for packing. In addition, the adhesive qualities on the outer surface of the modular elements preferably dissipate with cooling, drying, curing, etc., after the modular elements are combined, so that the protective device does not continue to be adhering during and after the packing process.

Figure 8A:
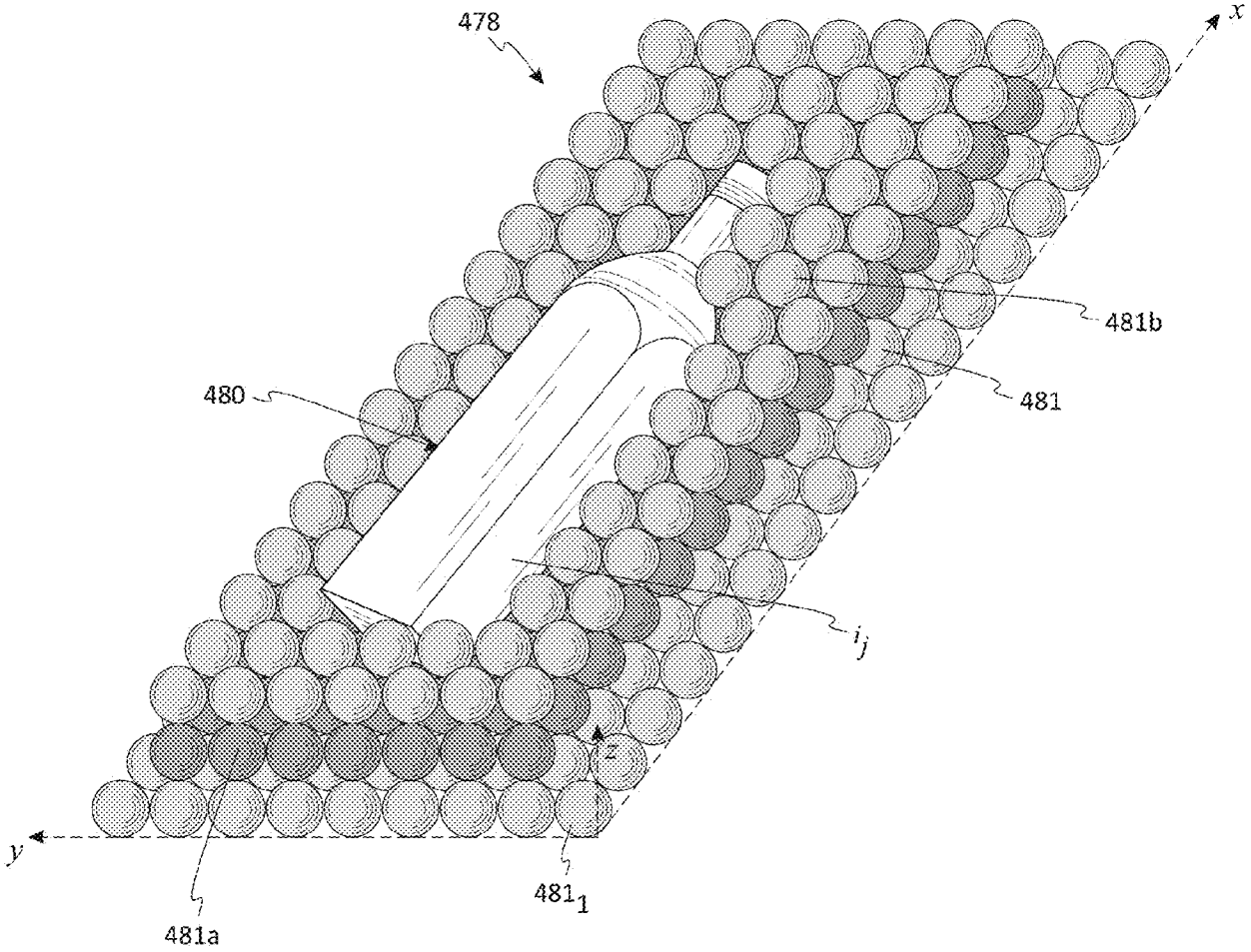
FIG. 8A illustrates a perspective view of an example protective structure for packing items in an order, according to aspects of the present disclosure.

FIG. 8A illustrates a perspective view of an example protective structure 478 that can be manufactured by the automated packaging manufacturing system 150 according to a custom packaging specification. In particular, the protective structure 478 includes a plurality of modular elements 481 that are assembled three-dimensionally to provide a shape that accommodates an item $i_j$ (i.e., an olive oil bottle) for packing. As shown in corresponding FIGS. 8B and 8C, the assembly of modular elements 481 defines a recess 480 that is shaped to receive the item $i_j$, i.e., half the item $i_j$ is received securely in the recess 480. The recess 480 positions the item $i_j$ (e.g., centrally) for enhanced support and protection by the protective structure 478 during shipment.

Figure 8B:
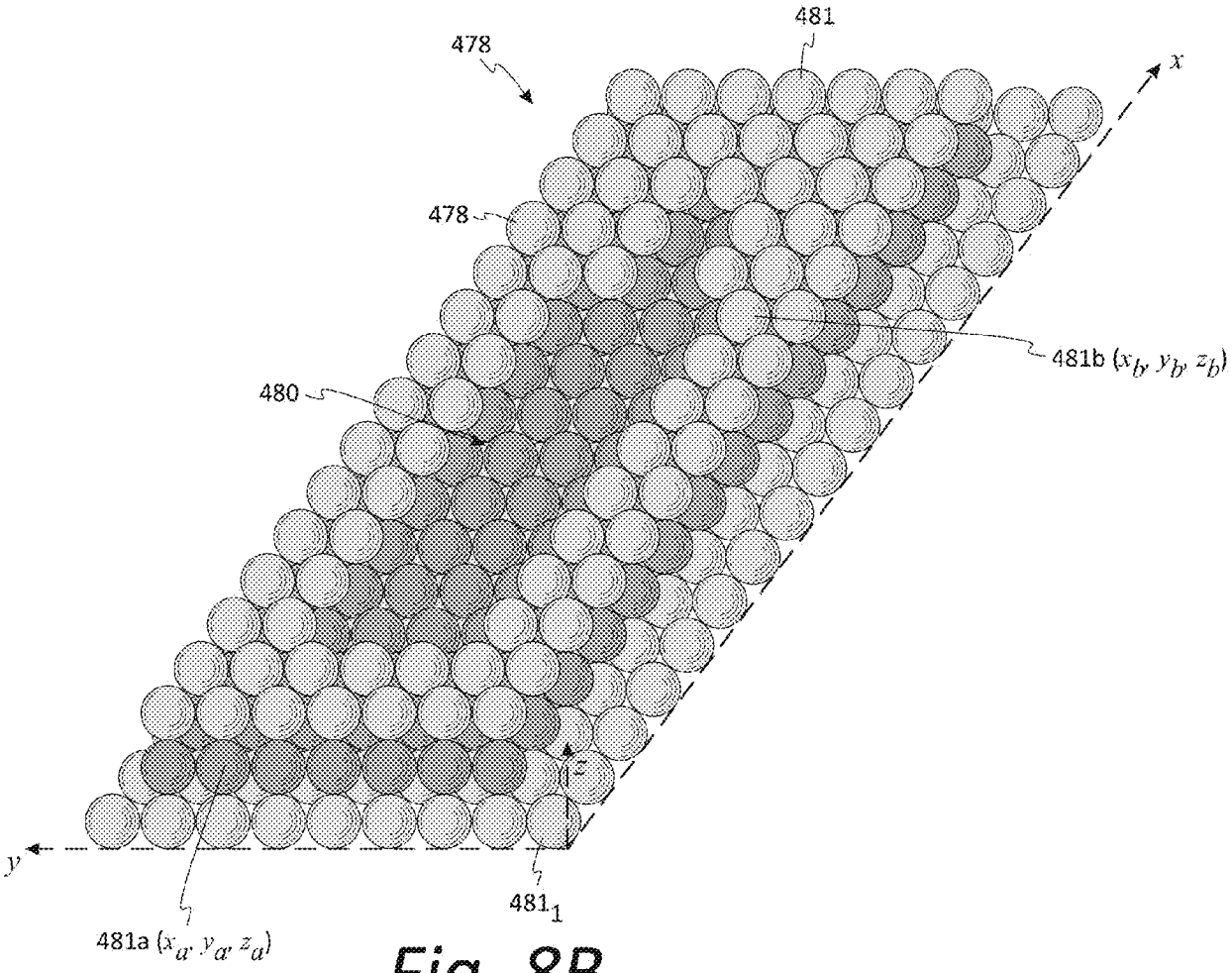
FIG. 8B illustrates another perspective view of the example protective structure of FIG. 8A.
Figure 8C:
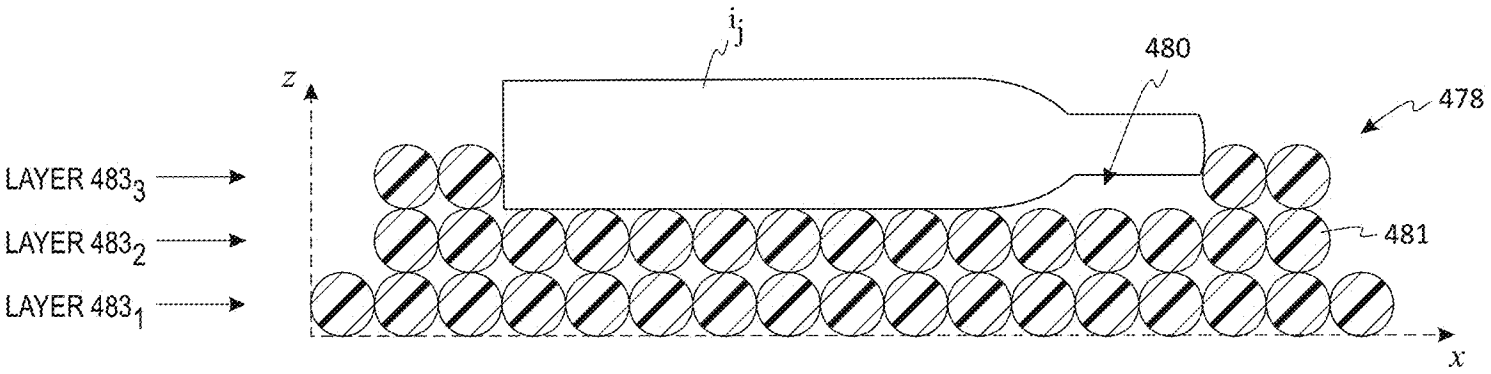
FIG. 8C illustrates a cross-sectional view of the example protective structure of FIG. 8A.

As described above, a voxel-based approach may be employed to produce the custom packaging specification for the protective structure 478. In general, a voxel describes a three-dimensional volumetric pixel, which can be used to break down any geometry according to any desired resolution or scale. As the protective structure 478 can be broken down into individual modular elements 481, each modular element 481 can be conceptually represented by a voxel to develop the custom packaging specification. As shown in FIGS. 8A-C, the modular elements 481 are substantially spherical and are substantially similar in size. Here, the substantially uniform shape and size of the modular elements 481 allows each modular element 481 to occupy a 1×1×1 volumetric unit (voxel) in a conceptual three-dimensional Cartesian space. As such, the custom packaging specification can specify the position of each modular element 481 in the protective structure 478 by indicating the respective Cartesian coordinates (x, y, z), e.g., modular element $\mathbf{481}_1$ positioned at (1, 1, 1), modular element 481*a* positioned at ($x_a$, $y_a$, $z_a$), modular element 481*b* positioned at ($x_b$, $y_b$, $z_b$), etc., as shown in FIGS. 8A and 8B.

As described herein, the structural aspects of a protective structure can be specified via Cartesian coordinates; however, it is understood that other coordinate systems (e.g., polar coordinate system) and/or other approaches for spatial description may be similarly employed.

Figure 8D:
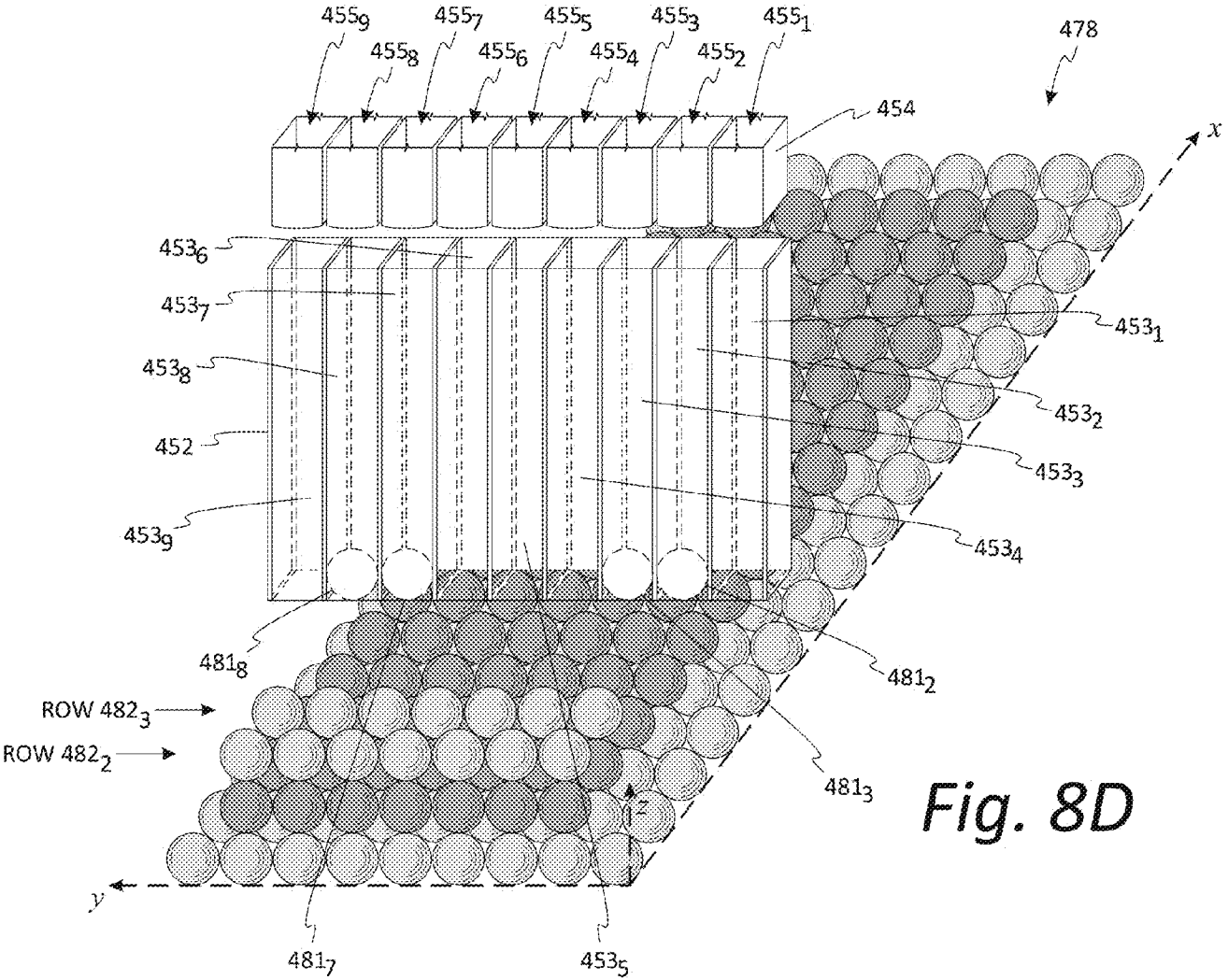
FIG. 8D illustrates an example system for manufacturing the example protective structure of FIG. 8A, according to aspects of the present disclosure.
Figure 8E:
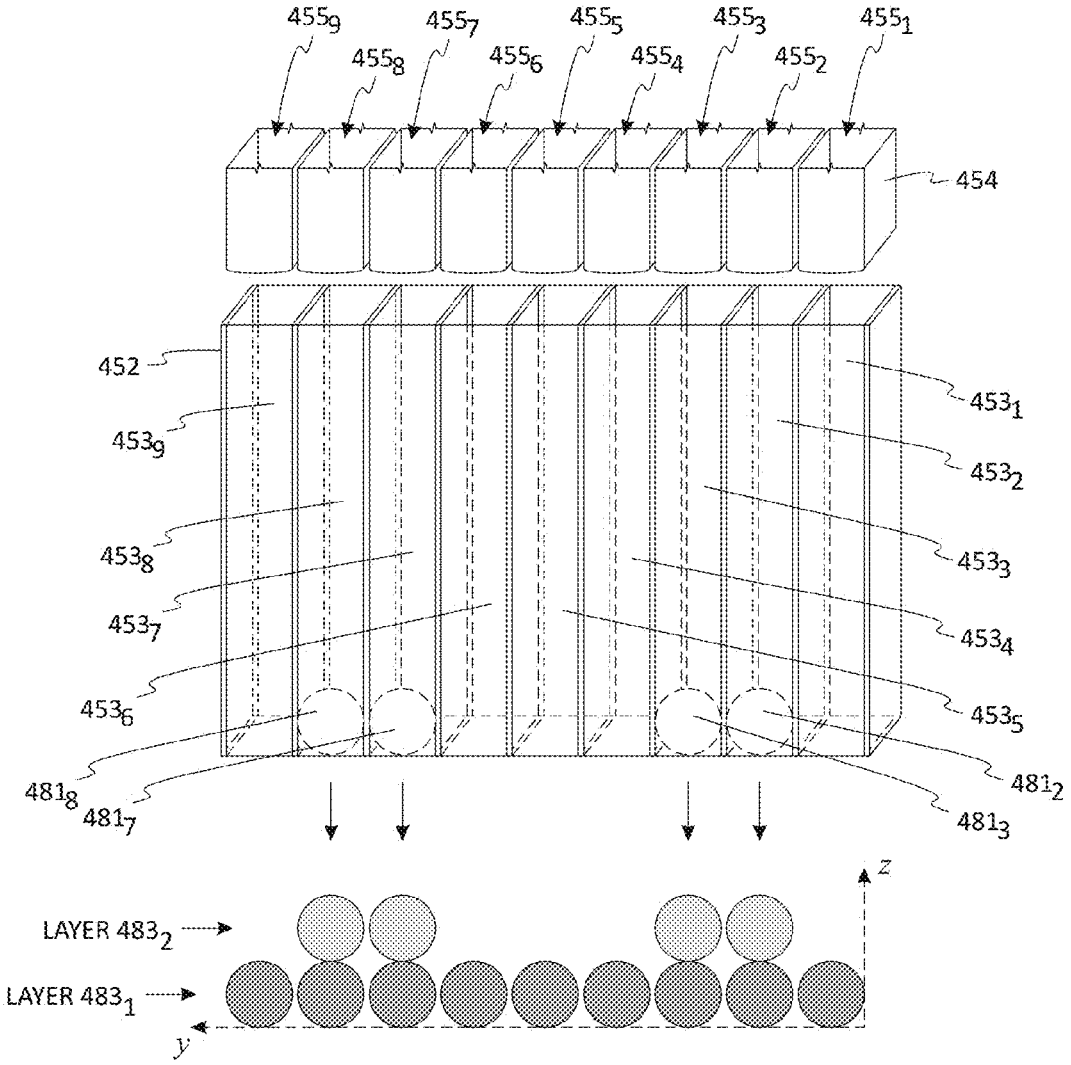
FIG. 8E illustrates another view of the example manufacturing system of FIG. 8D.

Corresponding FIGS. 8D and 8E illustrate an example approach for arranging the modular elements 481 in the three-dimensional space to produce the protective structure 478. In particular, the automated packaging manufacturing system 150 may include a feeder 452 that can move along the x-axis. The feeder 452, for example, may be coupled to one or more motors that actuate linear movement of the feeder 452 along the x-axis. At incremental positions u along the x-axis, the feeder 452 can deposit (or deliver) a row $\mathbf{482}_u$ of modular elements 481. The modular elements 481 in the row $\mathbf{482}_u$ are arranged at any of the v positions along the y-axis. By depositing a plurality of rows $\mathbf{482}_u$ in a first pass along the x-axis (e.g., in the positive x-direction), the feeder 452 forms a first layer $\mathbf{483}_1$ of modular elements 481 over the x-y plane. The first layer $\mathbf{483}_1$ is shown, for example, in FIG. 8C. By depositing a plurality of rows $\mathbf{482}_u$ in repeated passes along the x-axis (i.e., alternately reciprocating in the positive and negative x-directions), the feeder 452 forms additional layers $\mathbf{483}_w$ over the first layer $\mathbf{483}_1$. The plurality of layers $\mathbf{483}_w$ are, thus, formed at incremental positions w along the z-axis.

As FIG. 8D illustrates, the feeder 452 has deposited the first and second layers $\mathbf{483}_1$ and $\mathbf{483}_2$ and is depositing row $\mathbf{482}_4$ after rows $\mathbf{482}_2$ and $\mathbf{482}_3$ for the top layer $\mathbf{483}_3$. As shown in FIGS. 8A-C, the resulting three layers $\mathbf{483}_{w=1\ to\ 3}$ eventually define the size and shape of the protective structure 478.

The position u of the feeder 452 along the x-axis represents the x-coordinate for the position of a modular element 481; the position v of a modular element 481 along the y-axis represents its y-coordinate; and the position w of the layer $\mathbf{483}_w$ along the z-axis represents the z-coordinate for a modular element 481 in the layer $\mathbf{483}_w$. Accordingly, as the feeder 452 passes through the positions (u, v, w), the feeder 452 can deposit each modular element 481 according to the respective Cartesian coordinates (x, y, z) in a voxel-based analysis. Although the example feeder 452 shown in FIGS. 8D and 8E might move only along the x-axis, it is understood that other embodiments may move a feeder along the y-axis and/or the z-axis or according to any degree of freedom (e.g., a feeder can move in a curved path).

As FIGS. 8D and 8E illustrate, the feeder 452 includes a plurality of chambers $\mathbf{453}_{v=1\ to\ 9}$ corresponding to the positions v along the y-axis. The feeder 452 can deposit a modular element 481 at a position v along the y-axis via the respective chamber $\mathbf{453}_v$. A dispenser 454 couples the chambers $\mathbf{453}_v$ to a source of modular elements 481 and delivers modular elements 481 to the chambers $\mathbf{453}_v$. The dispenser 454 controls which chambers $\mathbf{453}_v$ receive a modular element 481 for a particular row $\mathbf{482}_u$. For example, the dispenser 454 may include a controlled gate $\mathbf{455}_v$ that allows one modular element 481 to pass into the respective chamber $\mathbf{453}_v$. Each gate $\mathbf{455}_v$, for example, may be selectively controlled via an electromechanical and/or hydraulic mechanism. Additionally, the modular elements 481 can be received by, and deposited from, the chamber $\mathbf{453}_v$ by gravity, forced air, mechanically controlled plunger, etc. The dispenser 454 delivers the modular elements 481 into the chambers $\mathbf{453}_v$ so that the modular elements 481 in a row $\mathbf{482}_u$ are delivered at the appropriate time, i.e., when the feeder 452 is positioned at the desired position u.

To deposit the row $\mathbf{482}_4$ at position u=4 along the x-axis for the layer $\mathbf{483}_3$ as shown in FIGS. 8D and 8E, the gates $\mathbf{455}_2$, $\mathbf{455}_3$, $\mathbf{455}_7$, and $\mathbf{455}_8$ allow modular elements $\mathbf{481}_2$, $\mathbf{481}_3$, $\mathbf{481}_7$, and $\mathbf{481}_8$ to enter the chambers $\mathbf{453}_2$, $\mathbf{453}_3$, $\mathbf{453}_7$, and $\mathbf{453}_8$, respectively. On the other hand, the other chambers $\mathbf{453}_1$, $\mathbf{453}_4$, $\mathbf{453}_5$, $\mathbf{453}_6$, and $\mathbf{453}_9$ remain empty. As such, when the modular elements $\mathbf{481}_2$, $\mathbf{481}_3$, $\mathbf{481}_7$, and $\mathbf{481}_8$ are deposited from the feeder 452, the row $\mathbf{482}_4$ includes modular elements 481 at positions v=2, 3, 7, and 8 along the y-axis. In this case, the custom packaging specification provides that modular elements 481 should be deposited at coordinates (4, 2, 3), (4, 3, 3), (4, 7, 3), and (4, 8, 3), and the automatic packaging manufacturing system 150 operates the dispenser 454 and the feeder 452 to deposit the modular elements 481 accordingly.

The positions v=4, 5, and 6 are empty to define a part of the recess 480 in the protective structure 478. Meanwhile, the positions u=1 and 9 are empty, because the custom packaging specification may determine that packaging material (i.e., a modular element 481) is not required in those positions to provide sufficient support and protection for the item Advantageously, by using modular elements 481 to form the protective structure 478, the automatic packaging manufacturing system 150 can closely control how packaging material is distributed throughout the protective structure 478. As a result, the custom packaging specification can reduce the amount of packaging material used to form the protective structure 478, thereby reducing cost, waste of materials, environmental impact, etc. The voxel-based approach here strikes a balance between practical manufacturing and optimization of material consumption.

As discussed above, an adhesive material may be applied to the outer surface of the modular elements 481 to make them adhere to each other. The adhesive can be applied to the modular elements 481 of a row $\mathbf{482}_u$ with a dropper, spray, brush, and/or other applicator. In general, the application of an adhesive and any activation can occur before, during, and/or after the row $\mathbf{482}_u$ is placed into contact with other modular elements 481. The modular elements 481 adhere to each other as they are deposited by the feeder 452. When necessary, the automated packaging manufacturing system 150 may allow the modular elements 481 some time to adhere effectively through cooling, drying, curing, etc., after they come into contact with each other.

Figure 8F:
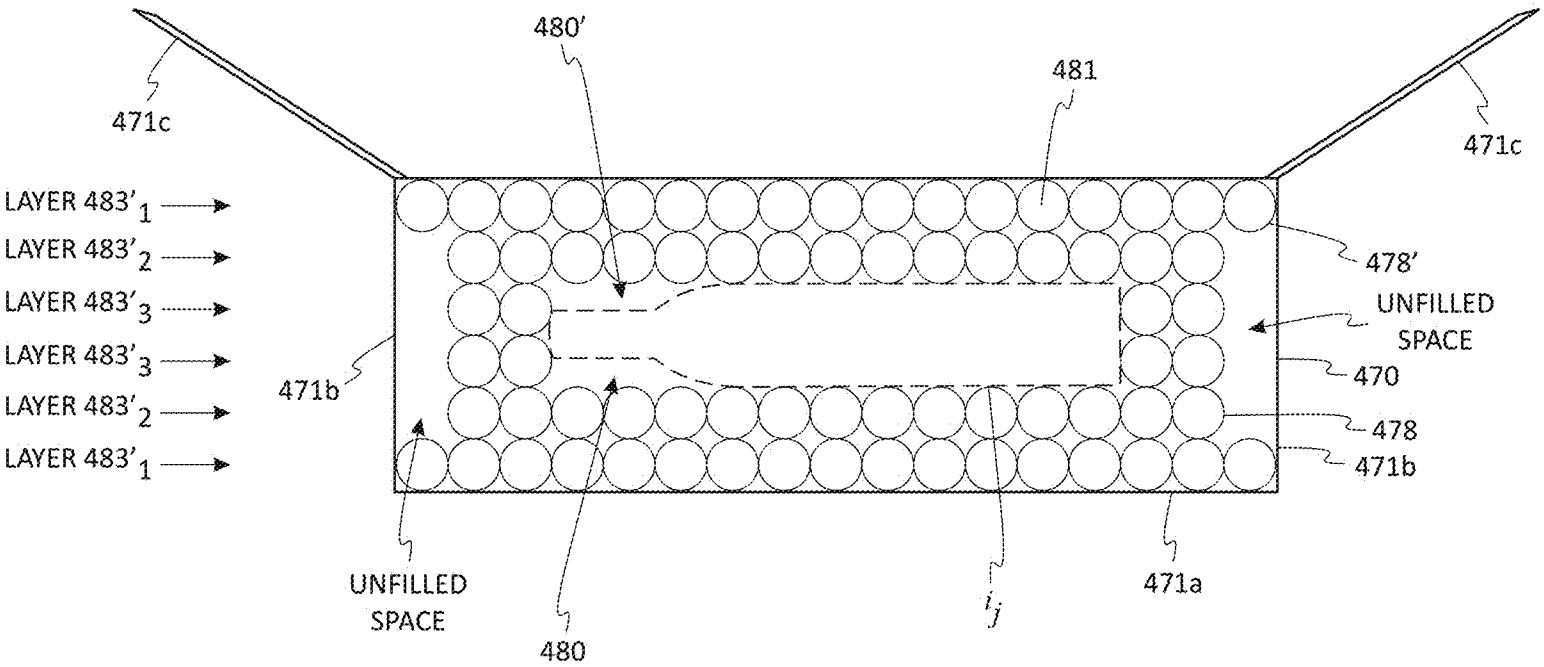
FIG. 8F illustrates the example protective structure of FIG. 8A positioned in a container, according to aspects of the present disclosure.

As shown in corresponding FIG. 8F, the protective structure 478 is placed into the selected container 470. The recess 480 receives the item $i_j$ and determines the three-dimensional position of the item $i_j$ relative to the container 470. In particular, the recess 480 positions the item $i_j$ (e.g., centrally) for enhanced support and protection within the container 470 during shipment. The first protective structure 478 supports and protects the item $i_j$ from the bottom. Therefore, a second protective structure 478' is positioned over the item $i_j$ to provide support and protection from above. The protective structure 478' also includes a recess 480' to accommodate the item $i_j$. Indeed, due to the symmetry of the item $i_j$, the second protective structure 478' may be a copy of the first protective structure 478. When combined, the recesses 480 and 480' of the protective structures 478 and 478', respectively, provide a cavity that positions the item $i_j$ in a desired location within the three-dimensional space of the container 470 as provided by the custom packaging specification.

As shown in FIG. 8F, the bottom layer $\mathbf{483}_1$ of the first protective structure 478 is situated on the bottom surface 471*a* of the container 470 and extends to the four side walls 471*b* of the container 370. Correspondingly, the top layer $\mathbf{483}_1'$ of the second protective structure 478' extends to the top of the container 470 where the top flaps 471*c* come together to close the container 470. In addition, the top layer $\mathbf{483}_1'$ of the second protective structure 478' extends to the four side walls 471*b* of the container 470. Because the bottom layer $\mathbf{483}_1$ and the top layer $\mathbf{483}_1'$ extend to all sides of the closed container 470, they act to prevent the protective structures 478 and 478' and thus the item $i_j$ from moving within the container 470.

The packaging optimization module 105 may determine that when the protective structures 478 and 478' are positioned in the container 470, the bottom layer $\mathbf{483}_1$ and the top layer $\mathbf{483}_1'$ provide sufficient protection from any shocks, impacts, vibrations, or other external forces received at the side walls 471*b* of the container 470. Therefore, as described above, the packaging optimization module 105 may determine that the other layers $\mathbf{483}_2$ and $\mathbf{483}_3$ of the first protective structure 478 and the other layers $\mathbf{483}_2'$ and $\mathbf{483}_3'$ of the second protective structure 478' do not have to extend to the side walls 471*b* of the container 470. Fewer modular elements 481 are thus used for the other layers $\mathbf{483}_2$, $\mathbf{483}_3$, $\mathbf{483}_2'$, and $\mathbf{483}_3'$ and space is left unfilled in the container 470. By using modular elements 481 to form the protective structure 478, the automatic packaging manufacturing system 150 can closely control how packaging material is distributed in the container 470. As a result, the custom packaging specification can reduce the amount of packaging material used to form the protective structure 478, thereby reducing shipment weight, waste of materials, cost, environmental impact, etc.

Although FIGS. 8A-F illustrate that the example protective structure 478 receives one item $i_j$, protective structures contemplated by the present disclosure can accommodate any number of items and/or any combination of different items. For instance, referring to FIGS. 9A and 9B, an example protective structure 578 includes more than one recess to receive different types of items. In particular, the two recesses 580*a* and 580*b* receive the item $i_k$ (thinking glass) and $i_l$ (drinking mug). To form the protective structure 578 with a configuration provided by a custom packaging specification, the automated packaging manufacturing system 150 can manipulate modular elements 581 in a manner similar to the modular elements 481 above. In particular, the feeder 452 and dispenser 454 may be employed to deposit rows and layers of modular elements 581 for the protective structure 578.

Figure 9A:
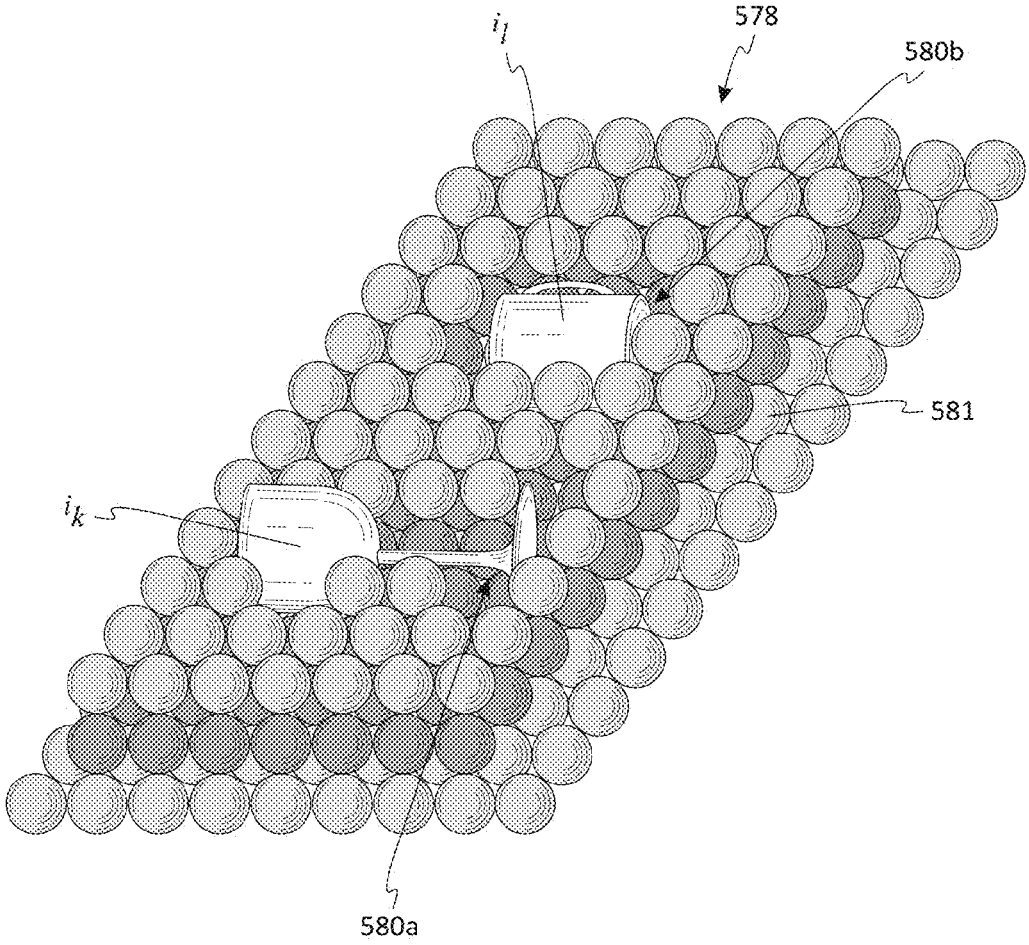
FIG. 9A illustrates a perspective view of another example protective structure for packing items in an order, according to aspects of the present disclosure.
Figure 9B:
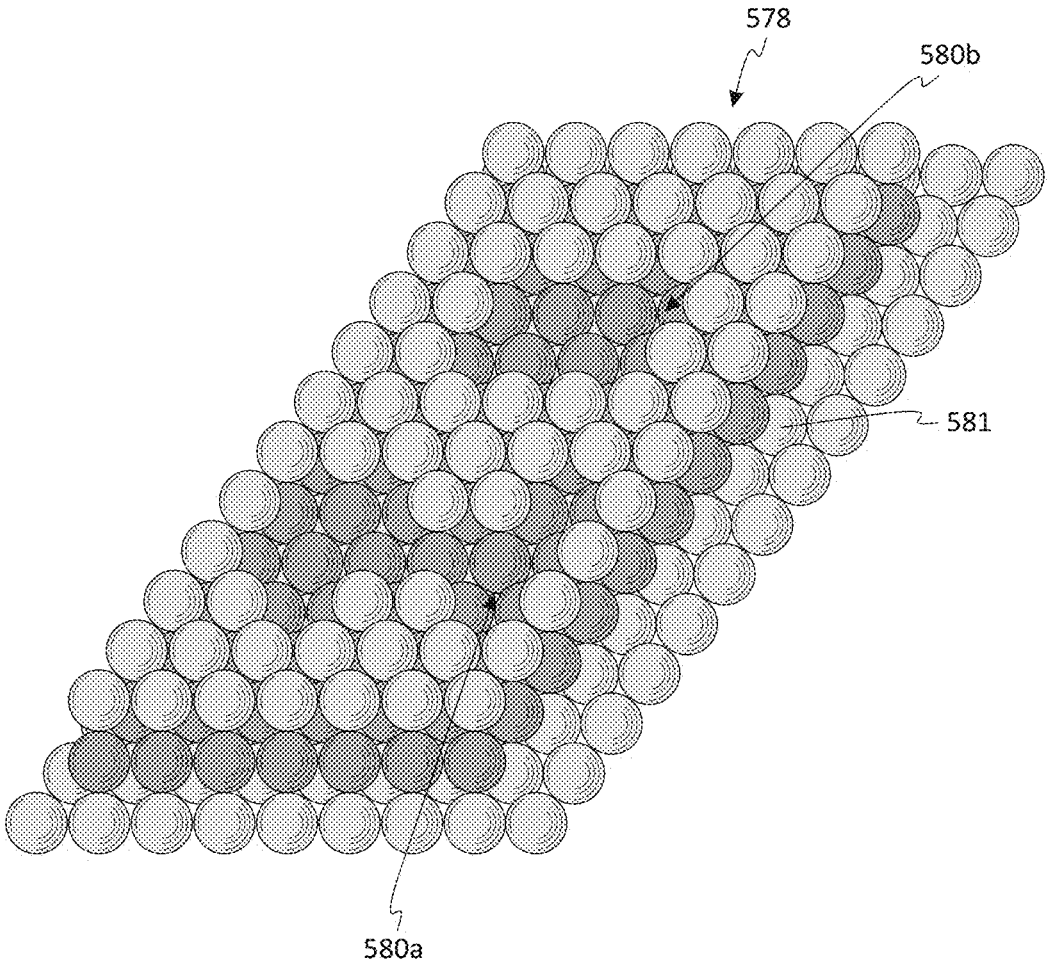
FIG. 9B illustrates another perspective view of the example protective structure of FIG. 9A.
Figure 10A:
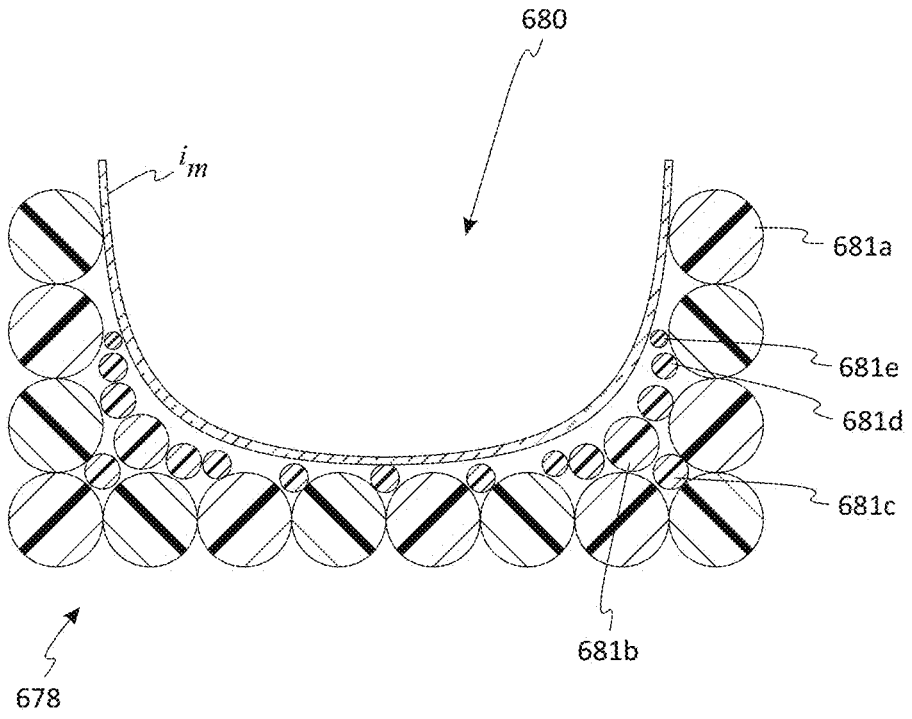
FIG. 10A illustrates a cross-sectional view of yet another example protective structure for packing items in an order, according to aspects of the present disclosure.

Like the modular elements 481, the modular elements 581 shown in FIGS. 9A and 9B are substantially similar in size. However, protective structures contemplated by the present disclosure can employ combinations of modular elements that are different in size. For instance, the cross-sectional view in FIG. 10A shows a plurality of modular elements 681*a*, 681*b*, 681*c*, 681*d*, and 681*e* arranged to form an example protective structure 678 according to a custom packaging specification. The protective structure 678 includes a contoured recess 680 that receives an item $i_m$ (a bowl with a contoured bottom). The modular elements 681*a-e* have five different respective sizes to facilitate the formation of the recess 680. As shown in FIG. 10A, the larger sized modular elements 681*a* may be used along the periphery of the protective structure 681, while the smaller sized modular elements 681*b-e* are employed to provide "higher resolution" shaping on the interior to define the contoured recess 680. The custom fit provided by the contoured recess 680 can provide enhanced support and protection for the item $i_m$.

Figure 10B:
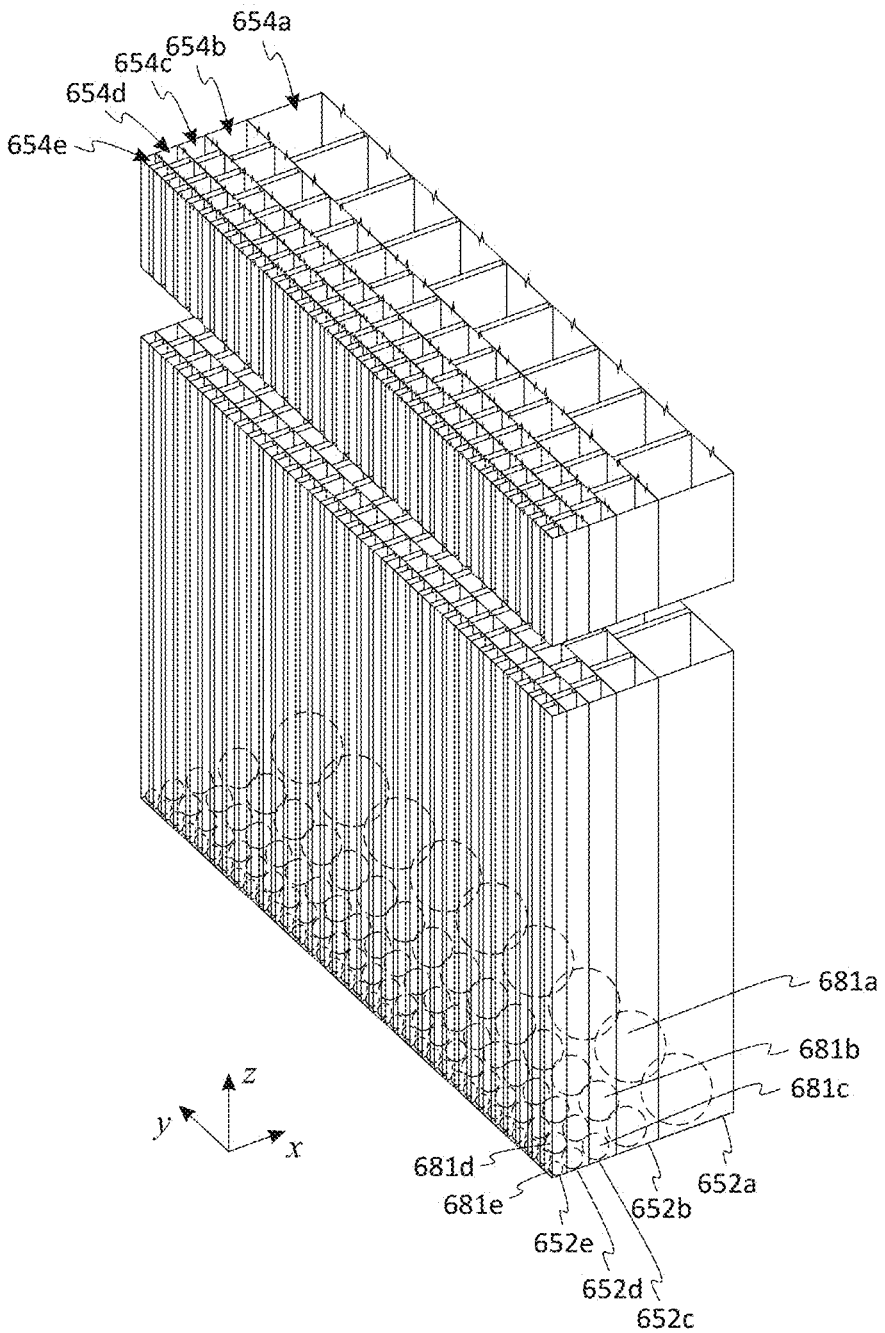
FIG. 10B illustrates an example system for manufacturing the example protective structure of FIG. 10A, according to aspects of the present disclosure.

To produce the protective structure 678, the automated packaging manufacturing system 150 may employ a process similar to the protective structures 478 and 578 described above. However, each modular element size may require a separate feeder and dispenser in the automated packaging manufacturing system 150. As shown in FIG. 10B, for example, feeders 652*a*, 652*b*, 652*c*, 652*d*, and 652*e* are coupled to dispensers 654*a*, 654*b*, 654*c*, 654*d*, and 654*e* and configured to deliver the modular elements 681*a*, 681*b*, 681*c*, 681*d*, and 681*e*, respectively. The feeders 652*a-e* may move together or separately along the x-axis. Each feeder 652*a*, 652*b*, 652*c*, 652*d*, or 652*e* can deposit respective modular elements 681*a*, 681*b*, 681*c*, 681*d*, or 681*e* at desired positions along the y-axis as the feeder passes designated positions along the x-axis. Reciprocating movement of the feeders 652*a-e* along the x-axis can then deposit different layers of the modular elements 681*a-e* along the z-axis to form the three-dimensional structure of the protective structure 678.

Because the modular elements 681*a-e* have different sizes, they can fit in a greater variety of spaces and locations in the protective structure 678. As such, the modular elements 681*a-e* may be distributed more efficiently and effectively throughout the protective structure 678 compared to protective structures with uniformly shaped modular elements. A voxel-based analysis for the protective structure 678 involves consideration of different volumetric units in the conceptual three-dimensional space.

In FIGS. 10A and 10B, five different sizes are available for the modular elements 681*a-e*. As shown in FIG. 10B, a different feeder 652*a*, 652*b*, 652*c*, 652*d*, or 652*e* delivers a respective one of the modular elements 681*a*, 681*b*, 681*c*, 681*d*, and 681*e*. If additional sizes for the modular elements are employed, the system for depositing the modular elements may become more complex and less practical. Thus, for practical purposes, the automated packaging manufacturing system 150 may limit the number of differently sized modular elements. In other implementations, for example, fewer sizes (e.g., two or three) may be employed. As a result, the packaging optimization module 105 may take the number of available modular element sizes into account when determining the custom packaging specification to meet other criteria.

The use of modular elements allows the protective structures to have any shape. In particular, aspects of the present disclosure can provide protective structures that are less conventional in shape. More conventional packaging configurations may employ a size and shape that corresponds closely to the size and shape of the container. For example, if a container (e.g., box) has a rectangular profile with a length l, a width w, and a height h, a conventional packaging configuration may mirror the same rectangular profile and provide a structure with the same length l, width w, and height h around the packaged items. According to aspects of the present disclosure, however, protective structures do not necessarily have the same shape as the container, i.e., the protective structure may have a non-rectangular shape for a rectangular container. As described above with reference to FIG. 8F, unfilled space may exist between the protective structure and the walls of the container (e.g., only air fills this space). In other words, sections of a side of the protective structure may be spaced from the inner surface of the facing wall of the container. Leaving this space unfilled reduces the amount of packaging material (i.e., modular elements) used for the protective structure, thereby reducing shipment weight, waste of materials, cost, environmental impact, etc.

To allow space to exist between the protective structure and the interior surfaces of the container, the protective devices may include leg-like structures that extend outwardly to engage the interior surfaces of the container and to position the protective structure within the container (e.g., more centrally away from the walls) to enhance protection. These leg-like structures may contribute to the less conventional shape of the protective structure.

In general, aspects of the protective devices may be shaped specifically to reduce amount of packaging material (i.e., modular elements) used for the protective structure. For example, the protective devices may include any number of recesses and/or cavities that are only filled by air. These recesses and/or cavities do not affect the ability of the protective structure to support and protect the packaged items.

Figure 11A:
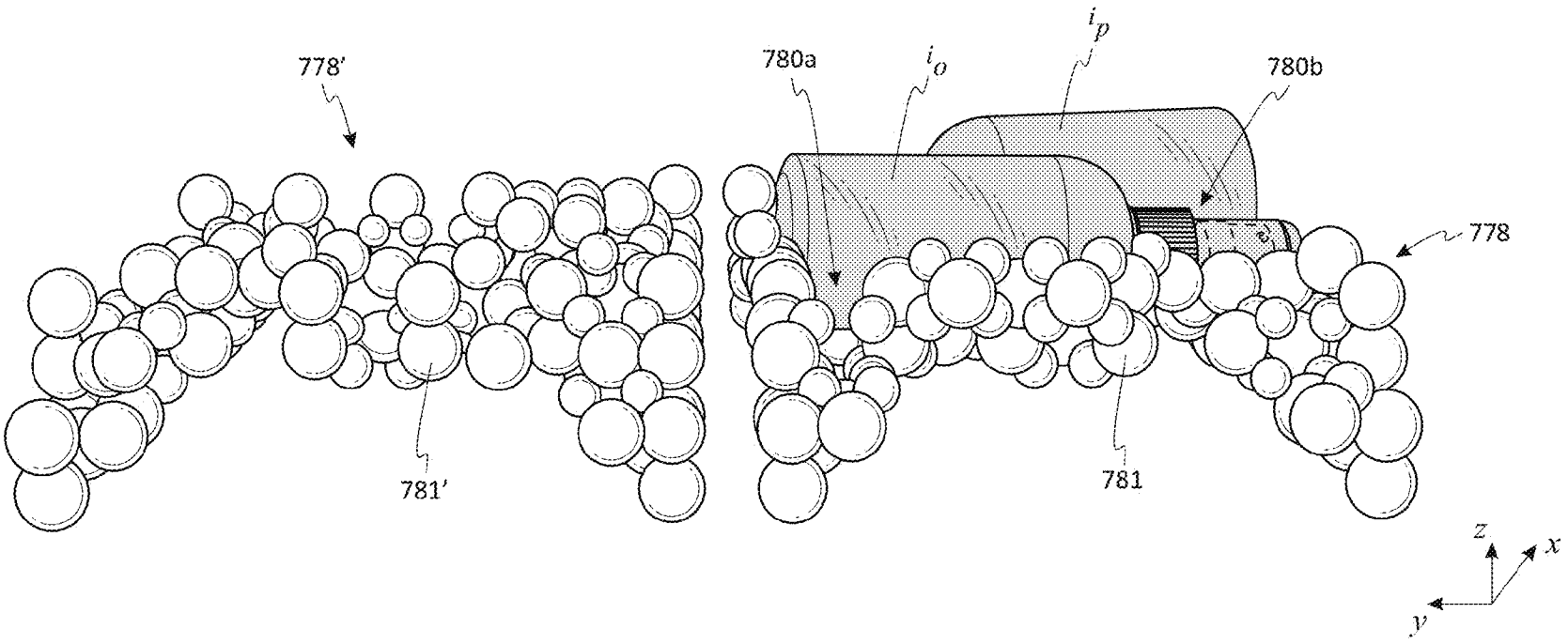
FIG. 11A illustrates a further example of protective structures for packing items in an order, according to aspects of the present disclosure.
Figure 11B:
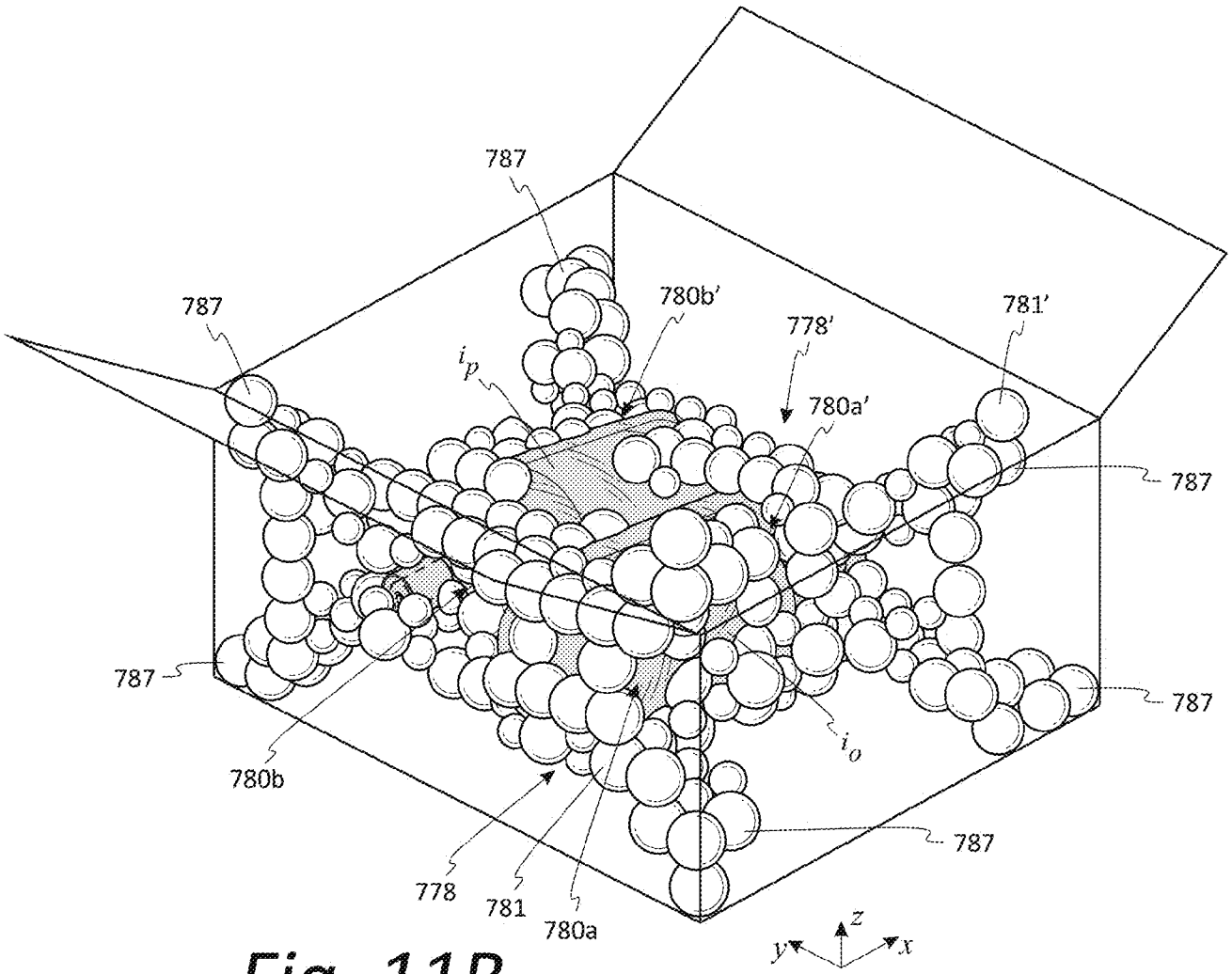
FIG. 11B illustrates the example protective structures of FIG. 11A positioned in a container, according to aspects of the present disclosure.

Referring to FIGS. 11A and 11B, differently sized modular elements 781 are arranged to form unconventionally shaped protective structures 778 and 778'. The first protective structure 778*a* includes recesses 780*a* and 780*b* to receive items $i_o$ and $i_p$ (lotion bottles), respectively, The first protective structure 778*a* supports and protects the items $i_o$ and $i_p$ from below. Meanwhile, as shown in FIG. 11B, the second protective structure 778' is placed over the items $i_o$ and $i_p$ to provide support and protection from above. The protective structure 778' also includes recesses 780*a'* and 780*b'* to accommodate the items $i_o$ and $i_p$, respectively. When the protective structures 778*a'* and 778*b'* are combined as shown in FIG. 11B and fit into a container 770, the recesses 780*a* and 780*a'* provide a cavity that encloses the item $i_o$ and can keep the item $i_o$ in a desired position in the three-dimensional space of the container 770. Correspondingly, the recesses 780*b* and 780*b'* provide a cavity that encloses the item $i_p$ and can keep the item $i_p$ in a desired position in the three-dimensional space of the container 770.

In addition to defining recesses for receiving and arranging the items for the container 770, the modular elements 781 also define features that allow the protective structure to be securely situated in the container 770. For example, as shown in FIG. 11B, the protective structure 778 includes leg-like structures 787 that extend outwardly to engage the interior surfaces of the container 770.

To reduce the amount of packaging material used, the protective structures, such as the protective structure 778, may have unconventional shapes. As shown in FIG. 11B, spaces in and around the protective structures 778 and 778' in the container 770 remain unfilled. Because the protective structures 778 and 778' provide sufficient support and protection for the items $i_o$ and $i_p$, filling these spaces with packaging material would waste material and add unnecessary weight for shipment.

Figure 12:
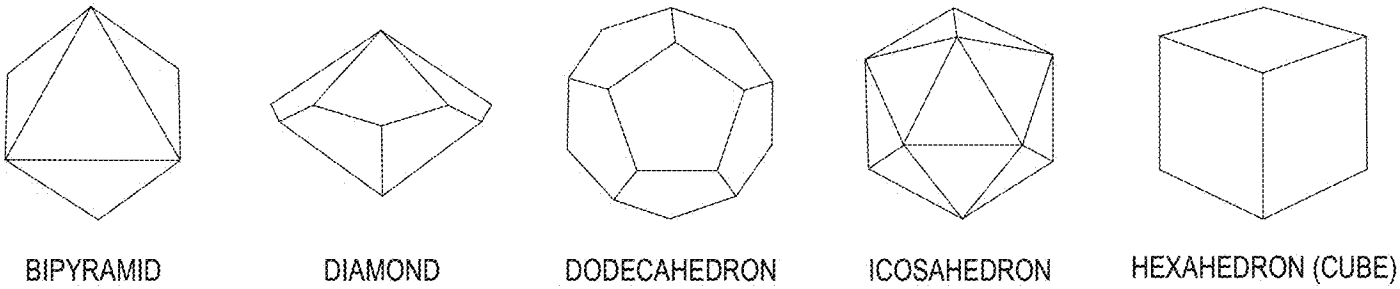
FIG. 12 illustrates example modular elements for forming protective structures for packing items in an order, according to aspects of the present disclosure.

Although the modular elements illustrated in FIGS. 8A-11B may appear to be substantially spherical, protective structures may include any combination of modular elements having different shapes. For example, FIG. 12 illustrates alternative shapes for modular elements that may be employed to form a protective structure. The alternative shapes include bipyramids, diamond-like shapes, dodecahedrons, icosahedrons, and hexahedrons (cubes), but are not limited to such shapes.

Figure 13:
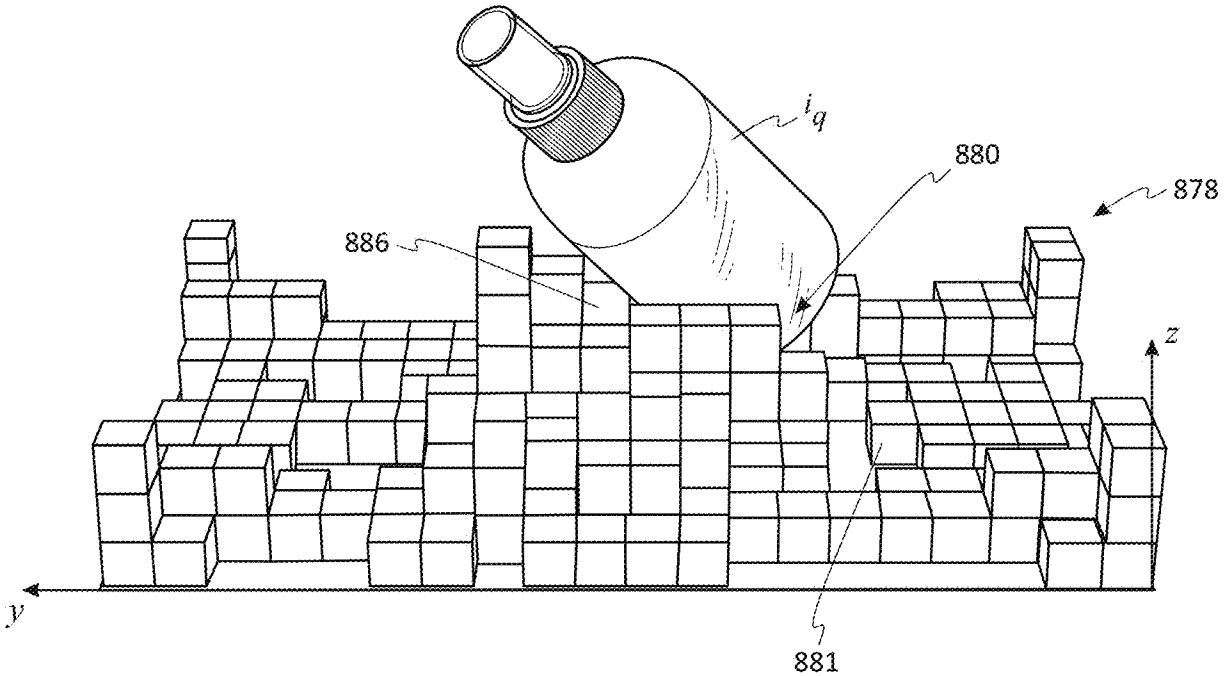
FIG. 13 illustrates another further example of a protective structure for packing items in an order, according to aspects of the present disclosure.

As FIG. 13 shows, an example protective structure 878 is formed from an arrangement of cube-shaped modular elements 881. The protective structure 878 provides several recesses for receiving and positioning items in a three-dimensional space. For instance, a recess 880 receives an item $i_q$ (a lotion bottle).

The features for arranging items in a three-dimensional space are not limited to recesses. For example, the protective structure 878 shown in FIG. 13 also includes projecting structures that extend in different directions to engage the items received by the protective structure 878. The protective structure 878 includes projecting structures 886 that extend upwardly to support the item $i_q$ vertically in a desired angled orientation. In general. protective structures may have any shape that provides recesses, projecting structures, and other features to position and orient items in a three-dimensional space.

The assembly of the modular elements to form protective structures can be implemented under automatic computer/machine control. As described above, the computing system 101 analyzes an order to produce a custom packaging specification that determines the shape of the protective structures and how modular elements should be assembled to produce the protective structures. In particular, the computer system determines the number of modular elements to use, what different sizes of modular elements to use, and how the modular elements should be positioned relative to each other. The automated packaging manufacturing system 150 may include a machine that can form the desired number of modular elements from a base material according to the desired shapes. Alternatively, the modular elements can be pre-formed in advance and are stored as inventory for subsequent assembly.

Figure 14A:
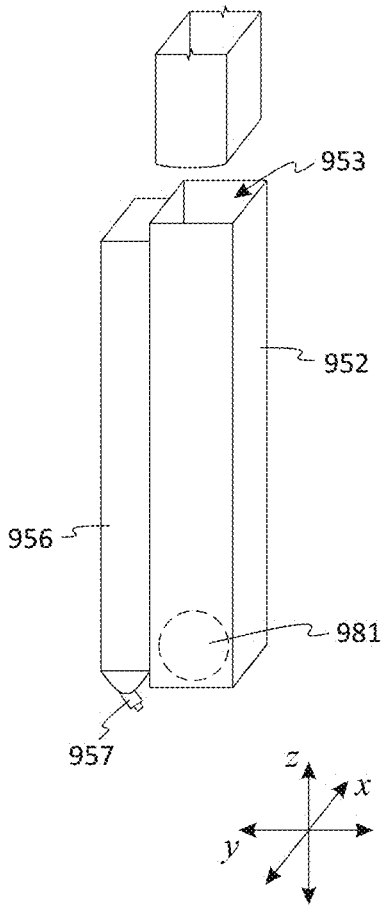
FIG. 14A illustrates an example system for manufacturing a protective structure for packing items in an order, according to aspects of the present disclosure.
Figure 14B:
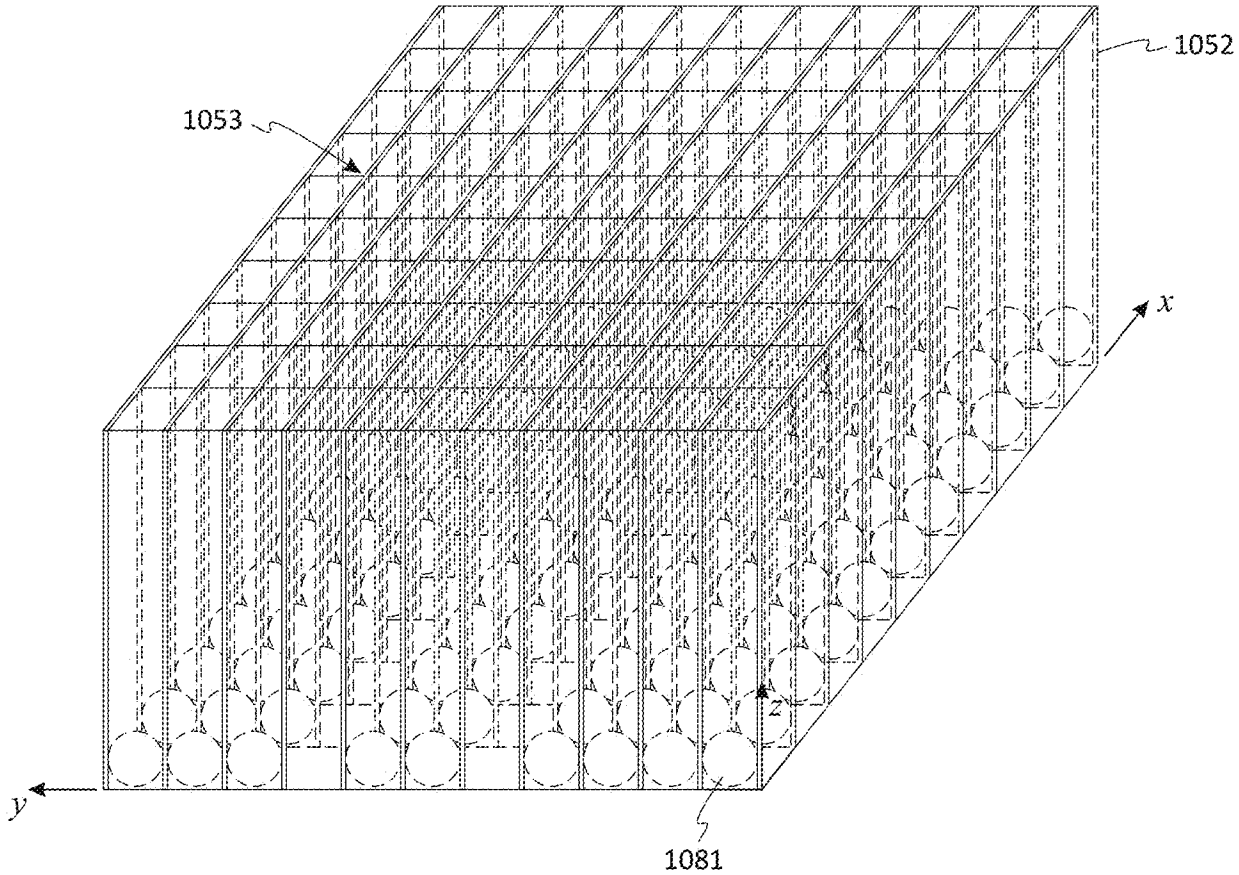
FIG. 14B illustrates another example system for manufacturing a protective structure for packing items in an order, according to aspects of the present disclosure.

The modular particles are then delivered to a machine which can arrange and assemble the modular elements. As described above, a feeder 452, for example, may move along the x-axis to deposit modular elements along the y-axis, and reciprocating movement of the feeder 452 along the x-axis allows the feeder 452 to form layers of modular elements along the z-axis and define the three-dimensional shape of the protective structure. However, the automated packaging manufacturing system 150 is not limited to the use of a device such as the feeder 452. As shown in FIGS. 14A and 14B, other devices may be employed to position the modular elements.

In particular, FIG. 14A illustrates an example feeder 952 that can move along the x-, y-, and z-axes to deposit individual modular elements 981 at desired positions in a three-dimensional space. The feeder 952 may be coupled to one or more motors that actuate movement of the feeder 952 along the three dimensions. As shown, the feeder 952 includes one chamber 953 to receive the modular elements 981. If differently sized and/or shaped modular elements are employed to form the protective device, additional chambers 953 can be added or an entirely separate feeder 952 may be employed for each type of modular element. In the example of FIG. 14A, an adhesive applicator 956 is also illustrated. The adhesive applicator 956 may include a nozzle or dropper 957 that is coupled to a source of adhesive. As each modular element 981 is deposited, the adhesive applicator 956 applies an adhesive that allows the modular element 981 to adhere to other modular elements 981 it contacts. Similar applicators can be employed in the embodiments described herein. As described above, for example, the applicator 956 may apply a liquid to a modular element 981 as it is falls from the chamber 953, and the liquid dries/solidifies in time to make the modular elements self-adhering as they come into contact with other modular elements. Additionally or alternatively, the applicator 956 can apply the adhesive after the modular elements come into contact to make adhesion stronger. Alternatively, the modular elements 981 are coated with an unactivated adhesive material that provides adhesive properties when it is subsequently treated (e.g., with water or solvents). As such, the applicator 956 can be employed to provide the activating treatment (e.g, by delivering water or solvents).

Meanwhile, FIG. 14B illustrates another example feeder 1052 that allows modular elements 1081 to be arranged in a two-dimensional grid (along the x- and y-axes) before they are deposited simultaneously as a layer. Repeated deposits from the feeder 1052 produces layers along the z-axis to define the three-dimensional shape of the protective structure. The feeder 1052 includes a plurality of chambers 1053 arranged in a two-dimensional grid to direct the modular elements. The position of each chamber 1053 determines its x, y-coordinates in the three-dimensional space. If differently sized and/or shaped modular elements are employed to form the protective device, separate feeders 1053 may be employed for each type of modular element.

The embodiments described herein may employ computing systems for processing information and controlling aspects of an order system 100. For example, in the computing system 101 shown in FIG. 1, the order processing module 103, the inventory module 104, the packaging optimization module 105, and the shipping module 108 process information relating to an order 2. Meanwhile, the picking/packing controller 106 controls the automated picking system 130, and the packaging manufacturing controller 107 controls the automated packaging manufacturing system 150. Generally, the computing system systems include one or more processors. For example, the computing system 101 include one or more shared or dedicated processors to provide the modules 102, 103, 104, and 107 and the controllers 105 and 106.

The processor(s) of a computing system may be implemented as a combination of hardware and software elements. The hardware elements may include combinations of operatively coupled hardware components, including microprocessors, communication/networking interfaces, memory, signal filters, circuitry, etc. The processors may be configured to perform operations specified by the software elements, e.g., computer-executable code stored on computer readable medium. The processors may be implemented in any device, system, or subsystem to provide functionality and operation according to the present disclosure. The processors may be implemented in any number of physical devices/machines. For example, the computing system 101 may include one or more shared or dedicated general purpose computer systems/servers to provide the modules 102, 103, 104, and 107 and the controllers 105 and 106. Indeed, parts of the processing of the example embodiments can be distributed over any combination of processors for better performance, reliability, cost, etc.

The physical devices/machines can be implemented by the preparation of integrated circuits or by interconnecting an appropriate network of conventional component circuits, as is appreciated by those skilled in the electrical art(s). The physical devices/machines, for example, may include field programmable gate arrays (FPGA's), application-specific integrated circuits (ASIC's), digital signal processors (DSP's), etc. The physical devices/machines may reside on a wired or wireless network, e.g., LAN, WAN, Internet, cloud, near-field communications, etc., to communicate with each other and/or other systems, e.g., Internet/web resources.

Appropriate software can be readily prepared by programmers of ordinary skill based on the teachings of the example embodiments, as is appreciated by those skilled in the software arts. Thus, the example embodiments are not limited to any specific combination of hardware circuitry and/or software. Stored on one computer readable medium or a combination of computer readable media, the computing systems may include software for controlling the devices and subsystems of the example embodiments, for driving the devices and subsystems of the example embodiments, for enabling the devices and subsystems of the example embodiments to interact with a human user (user interfaces, displays, controls), etc. Such software can include, but is not limited to, device drivers, operating systems, development tools, applications software, etc. A computer readable medium further can include the computer program product(s) for performing all or a portion of the processing performed by the example embodiments. Computer program products employed by the example embodiments can include any suitable interpretable or executable code mechanism, including but not limited to complete executable programs, interpretable programs, scripts, dynamic link libraries (DLLs), applets, etc. The processors may include, or be otherwise combined with, computer-readable media. Some forms of computer-readable media may include, for example, a hard disk, any other suitable magnetic medium, CD-ROM, CDRW, DVD, any other suitable optical medium, RAM, PROM, EPROM, FLASH-EPROM, any other suitable memory chip or cartridge, a carrier wave, or any other suitable medium from which a computer can read.

The computing systems may also include databases for storing data. For example, the computing system 101 includes an order database 03 for storing order information and an item database 06 for storing information on items for orders 2. Such databases may be stored on the computer readable media described above and may organize the data according to any appropriate approach. For examples, the data may be stored in relational databases, navigational databases, flat files, lookup tables, etc. Furthermore, the databases may be managed according to any type of database management software.

Although the system 100 determines custom packaging specifications 16 based on the characteristic data 14 of specific items i in an order 02, the determined custom packaging specifications 16 can be stored in a database (e.g., the order database 03) for retrieval when subsequent orders 02 are received for the same specific items i, according to some embodiments of the present disclosure.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A method for on-demand packaging of one or more items, comprising:

receiving a request to package one or more items;

in response to receiving the request, determining characteristic data for the one or more items, the characteristic data including an indication of a volume of each item;

determining one or more containers for packaging the one or more items based at least on the volume of each item;

determining an arrangement of the one or more items in the one or more containers;

determining one or more protective structures including one or more features configured to position the one or more items in the one or more containers according to the arrangement;

determining relative positions for a plurality of self-adhering modular elements to form the one or more protective structures with the one or more features;

receiving subsets of the plurality of self-adhering modular elements;

depositing the subsets of the plurality of self-adhering modular elements to corresponding relative positions to form at least one of the protective structures, the self-adhering modular elements adhering to each other as the subsets of self-adhering modular elements are deposited and the self-adhering modular elements come into contact with each other; and packaging the one or more items in the one or more containers with the one or more protective structures to position the one or more items in the one or more containers according to the arrangement.

2. The method of claim 1, further comprising applying an adhesive material to the self-adhering modular elements.

3. The method of claim 1, further comprising at least one of cooling, drying, or curing the plurality of self-adhering modular elements.

4. The method of claim 1, wherein at least one of the protective structures includes one or more outwardly extending structures, each outwardly extending structure being configured to extend from a side of the at least one of the protective structures to a facing interior surface of a respective container and to space a part of the side of the at least one of the protective structures from the facing interior surface of the respective container.

5. The method of claim 1, wherein the plurality of self-adhering modular elements includes more than one shape.

6. The method of claim 1, wherein the plurality of self-adhering modular elements includes more than one size.

7. The method of claim 1, wherein the plurality of self-adhering modular elements are formed from a material that has inherent adhesive properties to allow the self-adhering modular elements to adhere to each other.

8. The method of claim 1, wherein the subsets of the plurality of self-adhering modular elements are deposited with a feeder including an array of one or more chambers that receives each subset of self-adhering modular elements.

9. A method for on-demand packaging of at least one item, comprising:

receiving a request to package one or more items;

in response to receiving the request, determining characteristic data for the one or more items, the characteristic data including an indication of a volume of each item;

determining one or more containers for packaging the one or more items based at least on the volume of each item;

determining an arrangement of the one or more items in the one or more containers;

determining one or more protective structures including one or more features configured to position the one or more items in the one or more containers according to the arrangement;

determining relative positions for a plurality of modular elements to form the one or more protective structures with the one or more features;

receiving subsets of the plurality of modular elements including an unactivated adhesive material applied thereto;

depositing the subsets of the plurality of modular elements to corresponding relative positions to form at least one of the protective structures;

activating the unactivated adhesive material on the subsets of modular elements to cause the plurality of modular elements to adhere to each other while disposed in the relative positions; and packaging the one or more items in the one or more containers with the one or more protective structures to position the one or more items in the one or more containers according to the arrangement.

10. The method of claim 9, wherein activating the unactivated adhesive material includes treating the plurality of modular elements with water.

11. The method of claim 9, wherein activating the unactivated adhesive material includes treating the plurality of modular elements with heat.

12. The method of claim 9, wherein activating the unactivated adhesive material includes treating the plurality of modular elements with a solvent.

13. The method of claim 9, further comprising at least one of cooling, drying, or curing the plurality of modular elements.

14. The method of claim 9, wherein at least one of the protective structures includes one or more outwardly extending structures, each outwardly extending structure being configured to extend from a side of the at least one of the protective structures to a facing interior surface of a respective container and to space a part of the side of the at least one of the protective structures from the facing interior surface of the respective container.

15. The method of claim 9, wherein the plurality of modular elements includes more than one shape.

16. The method of claim 9, wherein the plurality of modular elements includes more than one size.

17. The method of claim 9, wherein the subsets of the plurality of modular elements are deposited with a feeder including an array of one or more chambers that receives each subset of modular elements.

18. A system for manufacturing packaging, comprising:

a computing system configured to execute instructions stored on computer-readable media, the instructions causing the computing system to:

receive a request to package one or more items;

in response to receiving the request, determine characteristic data for the one or more items, the characteristic data including an indication of a volume of each item;

determine one or more containers for packaging the one or more items based at least on the volume of each item;

determine an arrangement of the one or more items in the one or more containers;

determine one or more protective structures including one or more features configured to position the one or more items in the one or more containers according to the arrangement; and determine relative positions for a plurality of modular elements to form the one or more protective structures with the one or more features;

a source for the plurality of modular elements; and a feeder coupled to the computing system and the source, the feeder including an array of one or more chambers, the one or more chambers receiving a subset of the plurality of modular elements, the feeder being configured to position the array to deposit the subset of modular elements into the respective relative positions to form at least one of the protective structures.

19. The system of claim 18, further comprising at least one applicator for applying an adhesive material to the plurality of modular elements.

20. The system of claim 18, wherein the modular elements are self-adhering, and the self-adhering modular elements adhere to each other as the subset of self-adhering modular elements are deposited and the self-adhering modular elements come into contact with each other.

21. The system of claim 18, wherein the modular elements include an unactivated adhesive material applied thereto, and the system further includes an activation system that activates the unactivated adhesive material on the subset of modular elements to cause the modular elements to adhere to each other while disposed in the relative positions.

22. The system of claim 18, wherein the array is a row, and the feeder delivers rows of modular elements at positions along an axis.

23. The system of claim 18, wherein the feeder makes multiple passes along the axis to deliver layers of modular elements.

24. The system of claim 18, wherein the array is a two-dimensional grid, and the feeder delivers layers of modular elements.

25. The system of claim 18, further comprising a dispenser that determines which chambers in the array receive modular elements for depositing, the dispenser including a respective gate for each chamber to control movement of the modular elements into the one or more chambers.

* * * * *